US009671812B2

(12) United States Patent
Madan et al.

(10) Patent No.: US 9,671,812 B2
(45) Date of Patent: Jun. 6, 2017

(54) APPARATUS AND METHODS FOR TEMPERATURE COMPENSATION OF VARIABLE CAPACITORS

(71) Applicant: TDK Corporation, Tokyo (JP)

(72) Inventors: Anuj Madan, Los Angeles, CA (US); David A. Zimlich, Carlsbad, CA (US)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 14/969,994

(22) Filed: Dec. 15, 2015

(65) Prior Publication Data

US 2016/0179124 A1 Jun. 23, 2016

Related U.S. Application Data

(60) Provisional application No. 62/093,309, filed on Dec. 17, 2014.

(51) Int. Cl.
*G05F 1/46* (2006.01)
*G05F 3/26* (2006.01)

(52) U.S. Cl.
CPC ..... *G05F 3/262* (2013.01)

(58) Field of Classification Search
CPC ... G05F 1/10; G05F 1/46; G05F 1/462; G05F 1/463; G05F 1/56; G05F 1/567; G05F 3/16; G05F 3/242; G05F 3/26; G11C 5/147
See application file for complete search history.

(56) References Cited

U.S. PATENT DOCUMENTS 4,878,151 A 10/1989 Gallichio
5,208,597 A 5/1993 Early et al.
5,321,597 A 6/1994 Alacoque
5,452,178 A 9/1995 Emesh et al.
6,018,265 A 1/2000 Keshtbod
6,211,745 B1 4/2001 Mucke et al.
6,222,221 B1 4/2001 Hou et al.
6,351,020 B1 2/2002 Tarabbia et al.
(Continued)

FOREIGN PATENT DOCUMENTS

EP 0 581 702 A1 2/1994
JP 63-308366 A 12/1988
(Continued)

OTHER PUBLICATIONS

Corrected Notice of Allowance in U.S. Appl. No. 14/288,115, mailed Jun. 10, 2015.
(Continued)

*Primary Examiner* — Gary L Laxton
(74) *Attorney, Agent, or Firm* — Nixon Peabody LLP

(57) ABSTRACT

Apparatus and methods for temperature compensation of variable capacitors are provided herein. In certain configurations, an integrated circuit (IC) includes a variable capacitor array, an array biasing circuit that biases cells of the variable capacitor array to control the array's capacitance, and a bias voltage level control circuit that generates one or more temperature dependent bias voltages used by the array biasing circuit to bias the variable capacitor array's cells. The bias voltage level control circuit controls the one or more temperature dependent bias voltages to change with temperature so as to compensate the variable capacitor array for changes to capacitance arising from temperature variation.

20 Claims, 12 Drawing Sheets

(56) References Cited

U.S. PATENT DOCUMENTS

| | | | | |
|---|---|---|---|---|
| 6,377,075 | B1 | 4/2002 | Wong | |
| 6,410,954 | B1 | 6/2002 | Sowlati et al. | |
| 6,657,509 | B1 | 12/2003 | Ohannes | |
| 6,674,321 | B1 | 1/2004 | York | |
| 6,765,778 | B1 | 7/2004 | Du et al. | |
| 6,788,159 | B2 * | 9/2004 | Takahashi | H03L 7/08 331/116 FE |
| 6,885,081 | B2 | 4/2005 | Morimoto | |
| 6,980,062 | B2 * | 12/2005 | Fujita | H03B 5/04 331/115 |
| 7,000,000 | B1 | 2/2006 | O'Brien | |
| 7,245,519 | B2 | 7/2007 | McQuirk et al. | |
| 7,251,121 | B2 | 7/2007 | Bhutta | |
| 7,280,001 | B2 | 10/2007 | Maligeorgos et al. | |
| 7,408,422 | B2 | 8/2008 | Dedieu et al. | |
| 7,453,136 | B2 | 11/2008 | Hakkarainen et al. | |
| 7,528,667 | B1 | 5/2009 | Tan et al. | |
| 7,920,030 | B2 | 4/2011 | Jang et al. | |
| 8,134,222 | B2 | 3/2012 | Khan et al. | |
| 8,324,069 | B1 | 12/2012 | Carns et al. | |
| 8,395,880 | B2 | 3/2013 | Wasson | |
| 8,531,862 | B2 | 9/2013 | Roest et al. | |
| 8,897,727 | B2 * | 11/2014 | Wang | H04B 17/0062 330/136 |
| 9,019,007 | B2 | 4/2015 | Gupta et al. | |
| 9,086,709 | B2 | 7/2015 | Gupta et al. | |
| 9,110,483 | B2 | 8/2015 | Madan et al. | |
| 9,201,442 | B2 | 12/2015 | Gupta et al. | |
| 9,350,291 | B2 * | 5/2016 | Itasaka | H03B 5/04 |
| 9,461,609 | B2 | 10/2016 | Madan et al. | |
| 9,461,610 | B2 | 10/2016 | Madan et al. | |
| 9,515,631 | B2 | 12/2016 | Madan et al. | |
| 2002/0140115 | A1 | 10/2002 | Inoh et al. | |
| 2004/0066244 | A1 | 4/2004 | Takinami et al. | |
| 2004/0127167 | A1 | 7/2004 | Zipper et al. | |
| 2005/0030116 | A1 | 2/2005 | Takagi | |
| 2005/0184812 | A1 | 8/2005 | Cho | |
| 2006/0006431 | A1 | 1/2006 | Jean et al. | |
| 2006/0043499 | A1 | 3/2006 | De Cremoux et al. | |
| 2006/0125121 | A1 | 6/2006 | Ko et al. | |
| 2007/0024386 | A1 * | 2/2007 | Yamamoto | H03B 5/36 331/158 |
| 2007/0075791 | A1 | 4/2007 | Dedieu et al. | |
| 2008/0048236 | A1 | 2/2008 | Kim | |
| 2008/0197923 | A1 | 8/2008 | Nakajima et al. | |
| 2008/0265977 | A1 | 10/2008 | Gu | |
| 2008/0267270 | A1 | 10/2008 | Darabi | |
| 2009/0096507 | A1 | 4/2009 | Gao et al. | |
| 2009/0128992 | A1 | 5/2009 | Haralabiois | |
| 2009/0160263 | A1 | 6/2009 | Spears et al. | |
| 2009/0243743 | A1 | 10/2009 | Kossel et al. | |
| 2009/0325521 | A1 | 12/2009 | Dubash et al. | |
| 2010/0052778 | A1 | 3/2010 | Baranauskas | |
| 2010/0079167 | A1 | 4/2010 | Thomsen | |
| 2010/0134182 | A1 | 6/2010 | Kapoor et al. | |
| 2011/0002080 | A1 | 1/2011 | Ranta | |
| 2011/0109380 | A1 | 5/2011 | Park et al. | |
| 2011/0121910 | A1 | 5/2011 | Yang et al. | |
| 2011/0298526 | A1 | 12/2011 | Homol et al. | |
| 2011/0316062 | A1 | 12/2011 | Kondo et al. | |
| 2012/0112820 | A1 | 5/2012 | Chokka et al. | |
| 2012/0211868 | A1 | 8/2012 | Stribley et al. | |
| 2012/0213015 | A1 | 8/2012 | Romanovskyy et al. | |
| 2013/0012141 | A1 | 1/2013 | Harnishfeger | |
| 2013/0038400 | A1 * | 2/2013 | Asamura | H03L 1/025 331/158 |
| 2013/0090067 | A1 | 4/2013 | Rofougaran et al. | |
| 2013/0335136 | A1 | 12/2013 | Nguyen | |
| 2014/0009211 | A1 | 1/2014 | Madan et al. | |
| 2014/0062575 | A1 | 3/2014 | Hurwitz | |
| 2014/0266408 | A1 | 9/2014 | Guimaraes et al. | |
| 2014/0354348 | A1 | 12/2014 | Gupta et al. | |
| 2014/0355172 | A1 | 12/2014 | Gupta et al. | |
| 2014/0367831 | A1 | 12/2014 | Yen et al. | |
| 2015/0130532 | A1 | 5/2015 | Madan et al. | |
| 2015/0205318 | A1 | 7/2015 | Gupta et al. | |
| 2016/0161970 | A1 | 6/2016 | Gupta et al. | |
| 2016/0163464 | A1 | 6/2016 | Madan et al. | |
| 2016/0163697 | A1 | 6/2016 | Madan et al. | |
| 2016/0164482 | A1 | 6/2016 | Madan et al. | |
| 2016/0164484 | A1 | 6/2016 | Madan et al. | |
| 2016/0164492 | A1 | 6/2016 | Madan et al. | |

FOREIGN PATENT DOCUMENTS

| | | | |
|---|---|---|---|
| JP | 2006-128468 | A | 5/2006 |
| WO | WO 2013/028546 | A1 | 2/2013 |
| WO | WO 2014/193503 | A1 | 12/2014 |
| WO | WO 2014/193846 | A1 | 12/2014 |

OTHER PUBLICATIONS

Corrected Notice of Allowance in U.S. Appl. No. 14/559,783, mailed Nov. 3, 2015.
Corrected Notice of Allowance in U.S. Appl. No. 14/601,137, mailed Jul. 10, 2015.
Corrected Notice of Allowance in U.S. Appl. No. 14/674,701, mailed Oct. 22, 2015.
International Search Report and Written Opinion for International Application No. PCT/US2014/018673, mailed Jun. 5, 2014.
International Search Report and Written Opinion for International Application No. PCT/US2014/039599, mailed Nov. 13, 2014.
International Search Report and Written Opinion for International Application No. PCT/US2015/058999, mailed Feb. 29, 2016.
Invitation to Pay Additional Fees with Communication Relating to the Results of the Partial International Search in International Application No. PCT/US2014/039599 mailed Aug. 12, 2014.
Notice of Allowance in U.S. Appl. No. 14/014,496, mailed Mar. 25, 2015.
Notice of Allowance in U.S. Appl. No. 14/288,115, mailed May 29, 2015.
Notice of Allowance in U.S. Appl. No. 14/559,783, mailed Jun. 9, 2016.
Notice of Allowance in U.S. Appl. No. 14/559,783, mailed Oct. 15, 2015.
Notice of Allowance in U.S. Appl. No. 14/601,137, mailed Jun. 24, 2015.
Notice of Allowance in U.S. Appl. No. 14/674,701, mailed Oct. 2, 2015.
Notice of Allowance in U.S. Appl. No. 14/705,386, mailed Jun. 8, 2016.
Notice of Allowance in U.S. Appl. No. 14/705,429, mailed Jul. 29, 2016.
Notice of Allowance in U.S. Appl. No. 14/705,476, mailed Dec. 20, 2016.
Office Action in U.S. Appl. No. 14/014,496, mailed Dec. 31, 2014.
Office Action in U.S. Appl. No. 14/014,496, mailed May 12, 2014.
Office Action in U.S. Appl. No. 14/559,783, mailed Feb. 12, 2016.
Office Action in U.S. Appl. No. 14/559,783, mailed Jun. 18, 2015.
Office Action in U.S. Appl. No. 14/559,783, mailed Mar. 19, 2015.
Office Action in U.S. Appl. No. 14/601,137, mailed Apr. 30, 2015.
Office Action in U.S. Appl. No. 14/674,701, mailed Jun. 9, 2015.
Office Action in U.S. Appl. No. 14/674,701, mailed May 13, 2015.
Office Action in U.S. Appl. No. 14/705,381, mailed Jul. 31, 2015.
Office Action in U.S. Appl. No. 14/705,381, mailed Mar. 22, 2016.
Office Action in U.S. Appl. No. 14/705,381, mailed Oct. 27, 2015.
Office Action in U.S. Appl. No. 14/705,381, mailed Sep. 9, 2016.
Office Action in U.S. Appl. No. 14/705,386, mailed Oct. 8, 2015.
Office Action in U.S. Appl. No. 14/705,429, mailed Mar. 31, 2016.
Office Action in U.S. Appl. No. 14/705,429, mailed Oct. 29, 2015.
Office Action in U.S. Appl. No. 14/705,476, mailed Aug. 31, 2015.
Office Action in U.S. Appl. No. 14/705,476, mailed Mar. 8, 2016.
Office Action in U.S. Appl. No. 14/705,476, mailed Nov. 9, 2015.
Office Action in U.S. Appl. No. 14/705,476, mailed Sep. 2, 2016.
Office Action in U.S. Appl. No. 14/952,451, mailed Apr. 7, 2016.
Office Action in U.S. Appl. No. 14/952,451, mailed Sep. 16, 2016.

(56) References Cited

OTHER PUBLICATIONS

International Search Report and Written Opinion for International Application No. PCT/US2015/065996, mailed Apr. 5, 2016.
Han Q. et al., "Perturbation Analysis and Experimental Verification of Intermodulation and Harmonic Distortion for an Anti-Series Varactor Pair", IEICE Transactions on Electronics, vol. E88-C, No. 1, Jan. 2005, pp. 89-97.
Kampe, A. et al., "An LC-VCO with one octave tuning range," IEEE European Conference on Circuit Theory and Design, vol. 3, Aug. 29, 2005, pp. 321-324.
Chen, Ming-Jer et al., "A Novel Cross-Coupled Inter-Poly-Oxide Capacito for Mixed-Mode CMOS Processes", IEEE Electron Device Letters, vol. 20, No. 7, Jul. 1999.
Nakamura, T. et al., "A Low-Phase-Noise Low-Power 27-GHz SiGe-VCO using Merged-Transformer Matching Circuit Technique," IEEE Radio Frequency Integrated Circuits Symposium, Jun. 2007, pp. 413-416.
Pietro Andreani et al., "On the Use of MOS Varactors in RF VCO's", IEEE Journal of Solid-State Circuits, vol. 35, No. 6, Jun. 2000, pp. 905-910.
Sauerbrey J. et al., "A 0.7-V MOSFET-Only Switched-Opamp Sigmadelta Modulator in Standard Digital CMOS Technology", IEEE Journal of Solid-State Circuits, vol. 37, No. 12, Dec. 2002, pp. 1662-1669.
Zhiqiang et al., "A Multi-Band RF CMOS LC Bandpass Filter with Continuous Frequency Tuning Design," 2010 International Conference on Computer Application and System Modeling (ICCASM 2010), 4 pages.

* cited by examiner

APPARATUS AND METHODS FOR TEMPERATURE COMPENSATION OF VARIABLE CAPACITORS

CROSS-REFERENCE TO RELATED APPLICATION

This application claims the benefit of priority under 35 U.S.C. §119(e) of U.S. Provisional Patent Application No. 62/093,309, filed Dec. 17, 2014 and titled "APPARATUS AND METHODS FOR CLOSED-LOOP TEMPERATURE COMPENSATION FOR A TUNABLE CAPACITOR," the entirety of which is hereby incorporated by reference.

BACKGROUND

Field

Embodiments of the invention relate to electronic systems and, in particular, to temperature compensated variable capacitors for radio frequency (RF) circuits.

Description of the Related Technology

A capacitor can include a pair of conductors separated by a dielectric. When a voltage is applied between the pair of conductors, an electric field can develop across the dielectric, which can lead to a store of charge in the capacitor. The capacitance of a capacitor corresponds to a ratio of the charge stored to a voltage difference between the conductors. Other parameters, such as quality factor (Q-factor), frequency response, and/or linearity, can also be important in selecting a capacitor that is appropriate for a particular application.

Capacitance can also vary with process and environment. For instance, capacitance can vary due to variations in a dielectric thickness across a semiconductor wafer. Also, capacitance can vary with temperature.

Capacitors can be used in a variety of types of analog and radio frequency (RF) circuits. For example, capacitors can be included in filters, duplexers, resonators, tuners, and/or other circuitry.

SUMMARY

In one aspect, an integrated circuit is provided. The integrated circuit includes a variable capacitor array comprising a plurality of variable capacitor cells, and an array biasing circuit configured to bias the plurality of variable capacitor cells to control a capacitance of the variable capacitor array. The array biasing circuit is configured to bias the plurality of variable capacitor cells based on one or more temperature dependent bias voltages. The integrated circuit further includes a bias voltage level control circuit configured to generate the one or more temperature dependent bias voltages. The bias voltage level control circuit includes a reference generator configured to generate a first temperature dependent reference signal, a first voltage regulator configured to generate a first regulated temperature dependent voltage based on the first temperature dependent reference signal, and analog circuitry configured to generate the one or more temperature dependent bias voltages based on the first regulated temperature dependent voltage. The one or more temperature dependent bias voltages are operable to compensate for a change in the capacitance of the variable capacitor array with temperature.

In another aspect, a method of providing a variable capacitance in a radio frequency (RF) system is provided. The method includes generating a first temperature dependent reference signal using a reference generator, generating a first regulated temperature dependent voltage based on the first temperature dependent reference signal using a first voltage regulator, generating one or more temperature dependent bias voltages based on the first regulated temperature dependent voltage using analog circuitry, and controlling a capacitance of a variable capacitor array by biasing a plurality of variable capacitor cells of the variable capacitor array using an array biasing circuit. Controlling the capacitance of the variable capacitor array includes biasing the plurality of variable capacitor cells based on the one or more temperature dependent bias voltages to compensate for a change in the capacitance of the variable capacitor array with temperature.

In another aspect, a bias voltage level control circuit for a variable capacitor is provided. The bias voltage level control circuit includes a reference generator configured to generate a first temperature dependent reference signal, a first voltage regulator configured to generate a first regulated temperature dependent voltage based on the first temperature dependent reference signal, and analog circuitry configured to generate one or more temperature dependent bias voltages based on the first regulated temperature dependent voltage. The one or more voltage levels of the one or more temperature dependent bias voltages change with temperature to compensate for a change in a capacitance of the variable capacitor with temperature.

DETAILED DESCRIPTION OF EMBODIMENTS

Figure 1A:
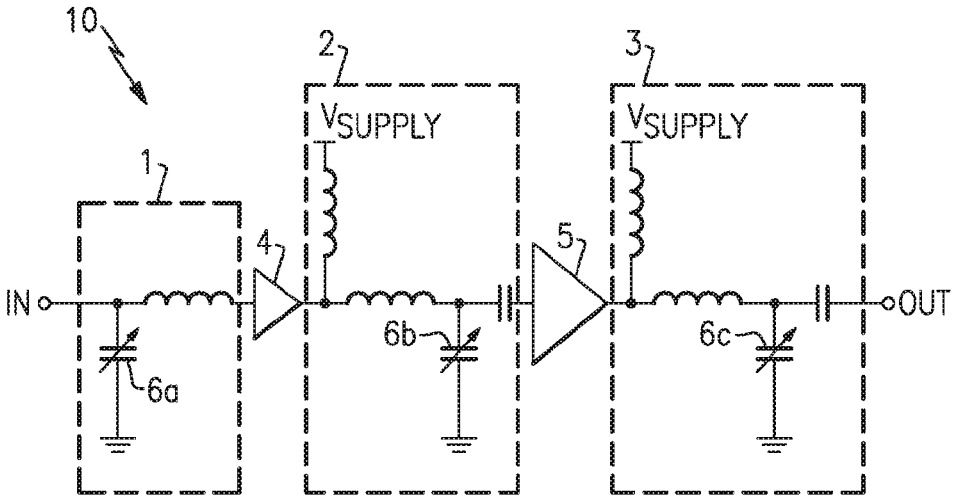
FIG. 1A is a schematic diagram of one embodiment of a power amplifier (PA) with tunable matching networks.

The following detailed description of certain embodiments presents various descriptions of specific embodiments of the invention. However, the invention can be embodied in a multitude of different ways as defined and covered by the claims. In this description, reference is made to the drawings in which like reference numerals may indicate identical or functionally similar elements.

Apparatus and methods for temperature compensation of variable or tunable capacitors are provided herein. In certain configurations, an integrated circuit (IC) includes a variable capacitor array, an array biasing circuit that biases cells of the variable capacitor array to control the array's capacitance, and a bias voltage level control circuit that generates one or more temperature dependent bias voltages used by the array biasing circuit to bias the variable capacitor array's cells. The bias voltage level control circuit controls the one or more temperature dependent bias voltages to change with temperature so as to compensate the variable capacitor array for changes to capacitance arising from temperature variation.

In certain implementations, the bias voltage level control circuit includes a reference generator that generates a proportional to absolute temperature (PTAT) reference signal and a negative to absolute temperature (NTAT) reference signal (also referred to herein as a complementary to absolute temperature reference signal). The bias voltage level control circuit further includes a first voltage regulator that generates a PTAT regulated voltage based on the PTAT reference signal, and a second voltage regulator that generates an NTAT regulated voltage based on the NTAT reference signal. In certain implementations, the first and second voltage regulators can be programmed to control at least one of offset or slope of the PTAT and NTAT regulated voltages with respect to a voltage versus temperature characteristic. Thus, PTAT and NTAT regulated voltages of desired temperature dependence can be obtained.

Additionally, the bias voltage level control circuit includes a combining circuit that combines the PTAT and NTAT regulated voltages to generate a combined voltage of desired temperature dependency and offset. In one embodiment, the combining circuit can be programmed to generate the combined voltage based on a linear combination of the PTAT regulated voltage and the NTAT regulated voltage. The bias voltage level control circuit further includes analog circuitry (for example, one or more charge pumps, buffers, and/or regulators) that uses the combined voltage to generate the temperature dependent bias voltages used for biasing the variable capacitor array. The temperature dependent bias voltages have a temperature versus voltage characteristic that compensates the cells being biased for changes in capacitance with respect to temperature. Thus, at a given capacitance setting, the variable capacitor array exhibits a substantially constant capacitance even when in the presence of temperature variation.

Accordingly, the bias voltage level control circuit is used to generate temperature dependent bias voltages that have a temperature dependence suitable for compensating for a change in capacitance of a variable capacitor array with temperature. Thus, even when the variable capacitor array operates in the presence of thermal variation, the capacitance of the variable capacitor array at a particular capacitance setting remains substantially constant.

In certain implementations, the variable capacitor array includes a plurality of variable capacitor cells electrically connected in parallel between a radio frequency (RF) input and an RF output of the IC. In certain configurations, the variable capacitor cells include one or more pairs of anti-series and/or anti-parallel metal oxide semiconductor (MOS) capacitors. For instance, to provide a high power handling capability suitable for a particular application, a variable capacitor cell can include a cascade of two or more pairs of MOS capacitors. The bias voltage level control circuit generates bias voltages used for biasing the MOS capacitors of the variable capacitor cells.

A MOS capacitor can include a gate that operates as an anode, and a source and drain that are electrically connected to one another and operate as a cathode. Additionally, a DC bias voltage between the MOS capacitor's anode and cathode can be used to control the MOS capacitor's capacitance. As used herein, a pair of MOS capacitors can be electrically connected in anti-series or inverse series when the pair of MOS capacitors is electrically connected in series with the first and second MOS capacitors' anodes electrically connected to one another or with the first and second MOS capacitors' cathodes electrically connected to one another. Additionally, a pair of MOS capacitors can be electrically connected in anti-parallel or inverse parallel when the pair of MOS capacitors is electrically connected such that an anode of the first MOS capacitor is electrically connected to a cathode of the second MOS capacitor and such that a cathode of the first MOS capacitor is electrically connected to an anode of the second MOS capacitor.

Using cascaded pairs of MOS capacitors in a variable capacitor array can result in the variable capacitor array exhibiting high RF signal handling and/or power handling capabilities. For example, including two or more pairs of anti-series MOS capacitors in a cascade can facilitate handling of RF signals with relatively large peak-to-peak voltage swings by distributing the RF signal voltage across multiple MOS capacitors. Thus, the variable capacitor array can handle RF signals of large voltage amplitude and/or high power without overvoltage conditions that may otherwise cause transistor damage, such as gate oxide punch through.

In certain configurations, the array biasing circuit can bias the MOS capacitors of a particular variable capacitor cell at a voltage level selected from a discrete number of two or more bias voltage levels associated with high linearity. Thus, rather than biasing the MOS capacitors at a bias voltage level selected from a continuous tuning voltage range, the array biasing circuit biases a particular cell with a bias voltage level selected from a discrete set of bias voltage levels associated with high linearity. In one embodiment, the array biasing circuit biases a particular MOS capacitor either at a first bias voltage level associated with an accumulation mode of the MOS capacitor or at a second bias voltage level associated an inversion mode of the MOS capacitor.

The capacitance of the MOS capacitors can also vary with temperature. For instance, capacitance can vary as a function of temperature thereby changing the capacitance at a particular bias level and thereby degrading performance. Accordingly, there is a need to compensate for variations in capacitance as a function of temperature.

In certain configurations, the two or more bias voltage levels can be controlled to vary or change with temperature so as to compensate for variations in capacitance as a function of temperature. In this way, the array biasing circuit can bias the MOS capacitors of a particular capacitor cell at a temperature dependent voltage level selected from a discrete number of two or more temperature dependent bias voltage levels. For instance, the bias voltage level control circuit can generate a bias voltage that increases or decreases with temperature, depending on the temperature versus capacitance characteristics of the cell being biased. The temperature versus capacitance characteristics of a cell can be determined in a wide variety of ways, such as by factory testing and/or using on-chip capacitance detection circuitry.

In certain implementations, the bias voltage level control circuit operates closed-loop, such that the bias voltage level control circuit is programmed to generate temperature dependent bias voltages with a desired degree of positive or negative slope, and the bias voltage level control circuit thereafter operates as a closed-loop system for compensating for a change in capacitance of a variable capacitor array with temperature. In other configurations, the bias voltage level control circuit operates open-loop based on one or more input signals to provide enhanced capacitance correction versus temperature. For example, in one embodiment, the bias voltage level control circuit receives a temperature signal indicative of the array's temperature, and the slope of the temperature dependent bias voltages is controlled based on the temperature signal.

As used herein and as persons having ordinary skill in the art will appreciate, the terms MOS capacitors refer to any types of capacitors made from transistors with insulated gates. For instance, MOS capacitors can have gates made from metals, such as aluminum, and dielectric regions made out of silicon oxide. However, these MOS capacitors can alternatively have gates made out of materials that are not metals, such as poly silicon, and can have dielectric regions implemented not just with silicon oxide, but with other dielectrics, such as high-k dielectrics. In certain embodiments, the MOS capacitors are implemented using fabricated using silicon on insulator (SOI) processes. For example, an integrated circuit can include a support substrate, a buried oxide (BOX) layer over the support substrate, and a device layer over the BOX layer, and the MOS capacitors can be fabricated in the device layer.

In certain embodiments, a variable capacitor array omits any switches in the signal path between the variable capacitor array's RF input and RF output. Switches can introduce insertion loss, degrade Q-factor, and/or decrease linearity. Thus, rather than providing capacitance tuning by opening and closing switches to set a number of active capacitors from a capacitor bank, capacitance tuning can be provided by biasing MOS capacitors of the variable capacitor cells at different bias voltage levels to provide a desired overall capacitance of the variable capacitor array. In certain configurations, the variable capacitor cells of the variable capacitor array can have the same or different weights or sizes, and the variable capacitor array's overall capacitance is based on a linear combination of the capacitances of the variable capacitor cells.

The variable capacitor arrays herein can exhibit substantially constant capacitance at a particular capacitance setting in the presence of temperature variation or change. The variable capacitor arrays can also exhibit have high RF voltage handling capability, while having a relatively small size, a relatively high Q-factor, a relatively high linearity, and/or a relatively low insertion loss. Furthermore, in certain implementations, a variable capacitor array can provide sufficient tuning range to provide filtering across a variety of different frequency bands. Accordingly, the variable capacitor array may be used to provide frequency tuning in a wide range of RF electronics, including, for example, programmable filters, programmable resonators, programmable antenna tuners, programmable impedance matching networks, programmable phase shifters, and/or programmable duplexers.

FIG. 1A is a schematic diagram of one embodiment of a power amplifier (PA) 10 with tunable matching networks. The power amplifier 10 includes an input matching network 1, a driver stage or preamplifier 4, an interstage matching network 2, an output stage 5, and an output matching network 3.

The input matching network 1 includes an input configured to receive an input RF signal at an input terminal IN and an output connected to an input of the driver stage 4. The input matching network 1 includes a first variable capacitor array 6*a* which controls the input matching network's impedance. The interstage matching network 2 includes an input configured to receive an output RF signal from an output of the driver stage 4 and an output connected to an input of the output stage 5. The interstage matching network 2 includes a second variable capacitor array 6*b* which controls the interstage matching network's impedance. The output matching network 3 includes an input configured to receive an output RF signal from an output of the output stage 5 and an output configured to provide an output RF signal at an output terminal OUT. The output matching network 3 includes a third variable capacitor array 6*c* which controls the output matching network's impedance.

Including the variable capacitor arrays 6*a*-6*c* in the matching networks 1-3 enhance the flexibility of the power amplifier 10, thereby aiding an end user in meeting or exceeding performance specifications. The variable capacitor arrays 6*a*-6*c* can be implemented in accordance with the teachings herein to reduce or eliminate capacitance variation in the presence of changes in temperature. Accordingly, the matching networks 1-3 can provide better impedance matching, thereby improving voltage standing wave ratio (VSWR) performance, improving linearity, and/or reducing distortion. Additionally, the matching networks 1-3 are tunable, which allows the power amplifier 10 to operate in accordance with a wide range of performance specifications.

Figure 1B:
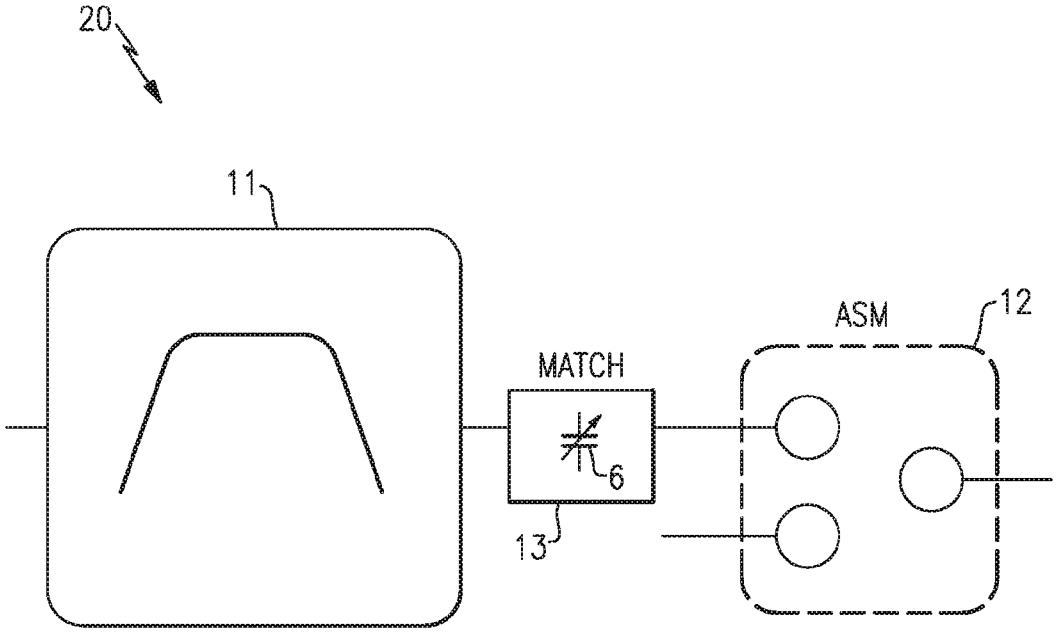
FIG. 1B is a schematic diagram of one embodiment of a radio frequency (RF) system.

FIG. 1B is a schematic diagram of one embodiment of an RF system 20. The RF system 20 includes a bandpass filter 11, a matching network 13 and an antenna switch module (ASM) 12. In certain implementations, the RF system 20 corresponds to an ASM/duplexer interface.

As shown in FIG. 1B, the matching network 13 is electrically connected between an output port of the bandpass filter 11 and an input port of the ASM 12. The matching network 13 includes a variable capacitor array 6 used in part to match an impedance at the output port of the bandpass filter 11 with an impedance at the input port of the ASM 12.

The variable capacitor array 6 can be implemented in accordance with the teachings herein to reduce or eliminate capacitance variation in the presence of change in temperature. Accordingly, the matching network 13 can provide enhanced impedance matching across temperature, thereby improving VSWR performance. The variable capacitor array 6 also allows the matching to be tunable, which allows the RF system 20 to operate in accordance with a wide range of performance specifications.

Figure 1C:
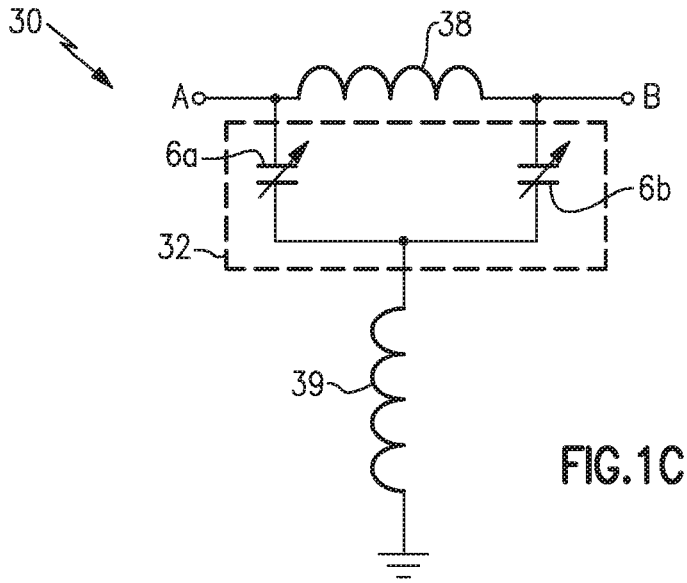
FIG. 1C is a schematic diagram of one embodiment of a tunable phase shifter.

FIG. 1C is a schematic diagram of one embodiment of a tunable phase shifter 30. The tunable phase shifter 30 has an input port A and an output port B. Additionally, the tunable phase shifter 30 includes a first inductor 38, a capacitor array section 32, and a second inductor 39. The capacitor array section 32 includes a first variable capacitor array 6*a* and a second variable capacitor array 6*b*.

The first inductor 38 is electrically connected between the input port A and the output port B. Additionally, the first variable capacitor array 6*a* is electrically connected between the input port A and a first node, and the second variable capacitor array 6*b* is electrically connected between the input port B and the first node. The second inductor 39 is electrically connected between the first node and ground, in this example. The tunable phase shifter 30 provides a phase shift between the input port A and the output port B, and the amount of phase shift changes based on the capacitance of the first and second variable capacitor arrays 6*a*, 6*b*. Accordingly, the variable capacitor arrays 6*a* and 6*b* can be used to adjust the phase shift of an RF signal propagating from the input port A to the output port B.

The variable capacitor arrays 6*a*, 6*b* can be implemented in accordance with the teachings herein to reduce or eliminate capacitance variation in the presence of change in temperature. Accordingly, the tunable phase shifter 30 exhibits excellent thermal performance, such as a substantially constant phase delay versus temperature characteristic. The variable capacitor arrays 6*a*, 6*b* also allow the phase shifter 30 to be tunable, thereby allowing the phase shifter 30 to be programmed to provide a phase shift desirable for a particular application and/or implementation.

Figure 1D:
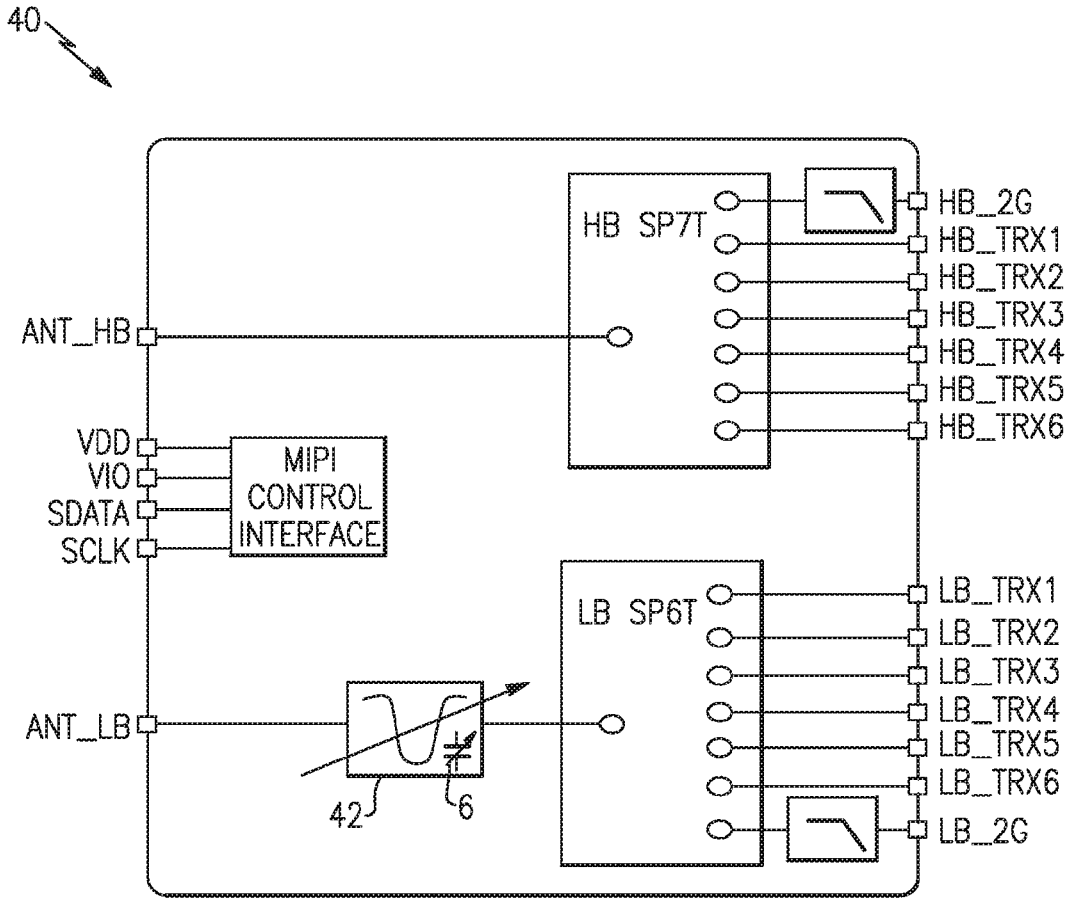
FIG. 1D is a schematic diagram of one embodiment of an antenna switch module (ASM).

FIG. 1D is a schematic diagram of one embodiment of an antenna switch module (ASM) 40. The ASM 40 includes a notch filter 42. The notch filter 42 includes a capacitor array 6, which can be used to change a range of rejected RF frequencies.

In the illustrated configuration, the ASM 40 includes a low band single pole six throw (LB SP6T) switch, a high band single pole seven throw (HB SP7T) switch, a high band 2 G filter, a low band 2 G filter, and a Mobile Industry Processor Interface control interface. The ASM 40 has also been annotated to show seven example high bands that the HB SP7T switch can be used to selectively couple to a high band antenna port (ANT_HB). Furthermore, the ASM 40 has been annotated to show six example low bands that the LB SP6T can be used to selectively couple to a low band antenna port (ANT_LB). However, other configurations are possible.

In certain implementations, the capacitance of the variable capacitor array 6 is controlled using the MIPI interface. As shown in FIG. 1D, the MIPI interface operates using VDD, VIO, SDATA, and SCLK pins.

In the illustrated embodiment, the variable capacitor array 6 is used to control a filtering characteristic of the notch filter 42, such as the location in frequency of a notch. Although the notch filter is illustrated as being electrically connected to the low band antenna port, other implementations are possible.

Although the RF systems of FIGS. 1A-1D illustrate various examples of electronic systems that can include one or more variable capacitor arrays, the variable capacitor arrays described herein can be used in other electronic systems. For example, variable capacitor arrays can be used in wide range of RF electronics, including, for example, programmable filters, programmable resonators, programmable antenna tuners, programmable impedance matching networks, programmable phase shifters, and/or programmable duplexers.

Figure 2A:
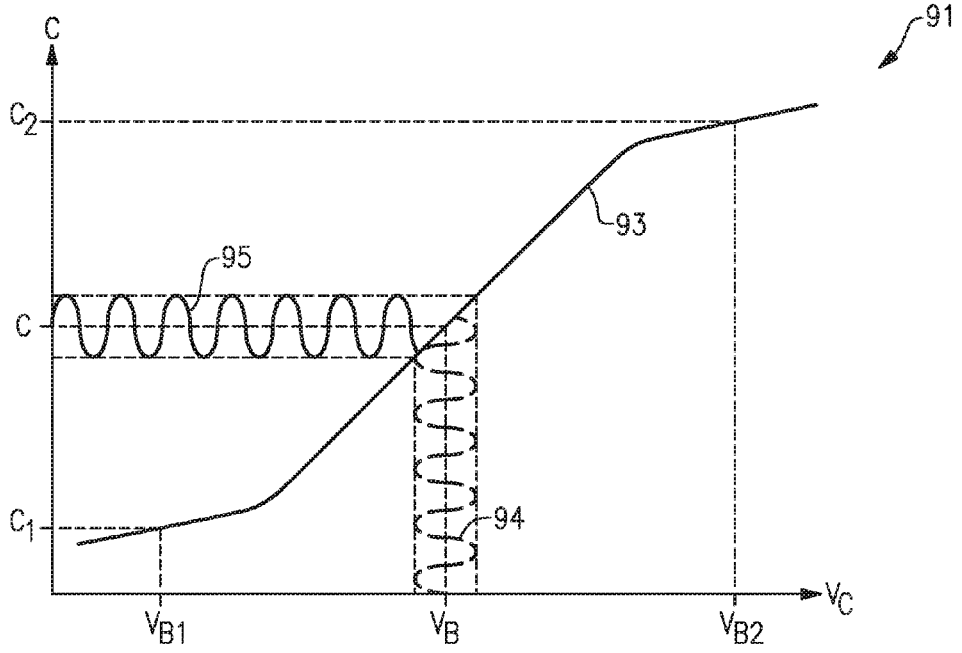
FIGS. 2A and 2B are graphs of two examples of capacitance versus bias voltage at a fixed temperature.
Figure 2B:
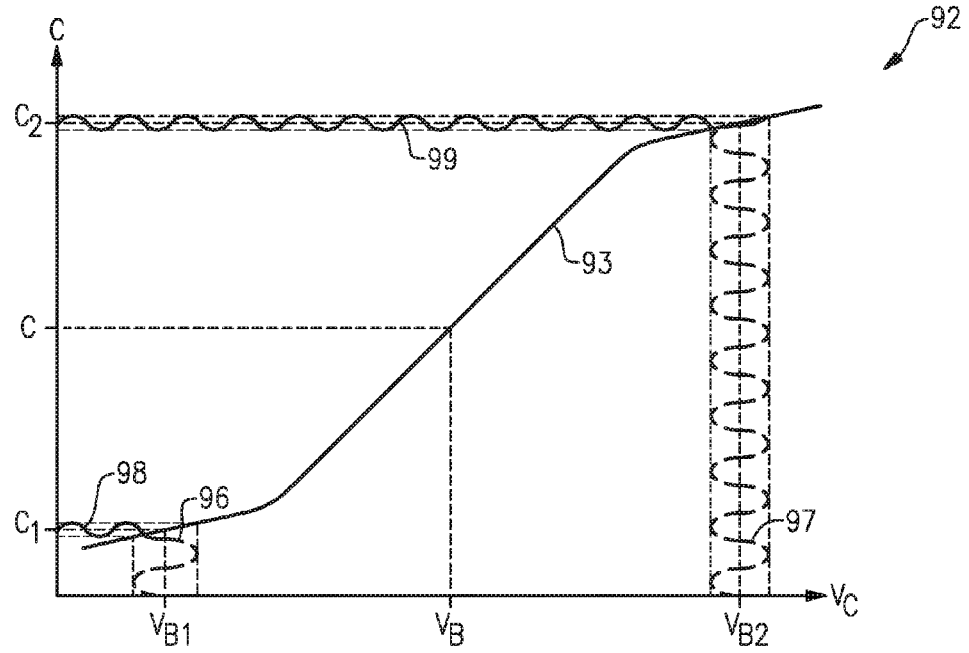

FIGS. 2A and 2B are graphs of two examples of capacitance versus bias voltage at a fixed temperature. FIG. 2A includes a first graph 91 of capacitance versus voltage at a fixed temperature, and FIG. 2B includes a second graph 92 of capacitance versus voltage at a fixed temperature.

The first graph 91 includes a fixed temperature high frequency capacitance-voltage (CV) plot 93 for one example of an n-type MOS capacitor. As shown in the CV plot 93, the capacitance of the MOS capacitor can increase with bias voltage level. The increase in capacitance can be associated with the MOS capacitor transitioning between operating regions or modes. For example, at low bias voltage levels, the MOS capacitor can operate in an accumulation mode in which a majority carrier concentration near the gate dielectric/semiconductor interface is greater than a background majority carrier concentration of the semiconductor. Additionally, as the voltage level of the bias voltage increases, the MOS capacitor can transition from the accumulation mode to a depletion mode in which minority and majority carrier concentrations near the gate dielectric/semiconductor interface are less than the background majority carrier concentration. Furthermore, as the voltage level of the bias voltage further increases, the MOS capacitor can transition from the depletion mode to an inversion mode in which the minority carrier concentration near the gate dielectric/semiconductor interface is greater than the background majority carrier concentration.

The first graph 91 has been annotated to include an AC signal component 94 when biasing the MOS capacitor at a bias voltage level $V_B$. When the AC signal component 94 is not present, the MOS capacitor can have a capacitance C. However, as shown by in FIG. 2A, the AC signal component 94 can generate a capacitance variation 95. The capacitance variation 95 can be associated with a capacitance variation generated by the AC signal component 94.

With reference to FIG. 2B, the second graph 92 includes the CV plot 93, which can be as described above. The second graph 92 has been annotated to include a first AC signal component 96 associated with biasing the MOS capacitor at a first bias voltage level $V_{B1}$, and a second AC signal component 97 associated with biasing the MOS capacitor at a second bias voltage level $V_{B2}$.

As shown in FIG. 2B, the first AC signal component 96 can generate a first capacitance variation 98, and the second AC signal component 97 can generate a second capacitance variation 99.

When biased at the first bias voltage level $V_{B1}$ or the second bias voltage level $V_{B2}$, the MOS capacitor can nevertheless have a capacitance that varies in the presence of AC signals. However, the first and second bias voltage levels $V_{B1}$, $V_{B2}$ can be associated with DC bias points of the MOS capacitor having relatively small capacitance variation or change.

Accordingly, in contrast to the capacitance variation 95 of FIG. 2A which has a relatively large magnitude, the first and second capacitance variations 98, 99 of FIG. 2B have a relatively small magnitude.

In certain embodiments herein, a variable capacitor array includes MOS capacitors that are biased at bias voltages associated with small capacitance variation. By biasing the MOS capacitors in this manner, a variable capacitor array can exhibit high linearity.

Such a variable capacitor array can also have less capacitance variation when operated in a system using multiple frequency bands. For example, the variable capacitor array can provide relatively constant capacitance even when tuned to frequency bands that are separated by a wide frequency.

In certain embodiments, the first bias voltage level $V_{B1}$ is selected to operate in the MOS capacitor in an accumulation mode, and the second bias voltage level $V_{B2}$ is selected to operate the MOS capacitor in an inversion mode. In certain configurations, biasing a MOS capacitor in this manner can achieve a capacitance tuning range of 3:1 or more. However, other tuning ranges can be realized, including, for example, a tuning range associated with a particular manufacturing process used to fabricate the MOS capacitor.

Because capacitance can vary with temperature, the CV plot 93, which shows capacitance versus voltage at a fixed temperature, can shift or otherwise change at a different temperature. As will be described herein, a bias voltage level control circuit can generate the first and second bias voltage levels $V_{B1}$, $V_{B2}$ to change with temperature so as to compensate for capacitance changes with temperature. Thus, the bias voltage level control circuit controls the bias voltage levels $V_{B1}$, $V_{B2}$ with temperature to reduce or eliminate capacitance variation of MOS capacitors being biased.

Figure 3:
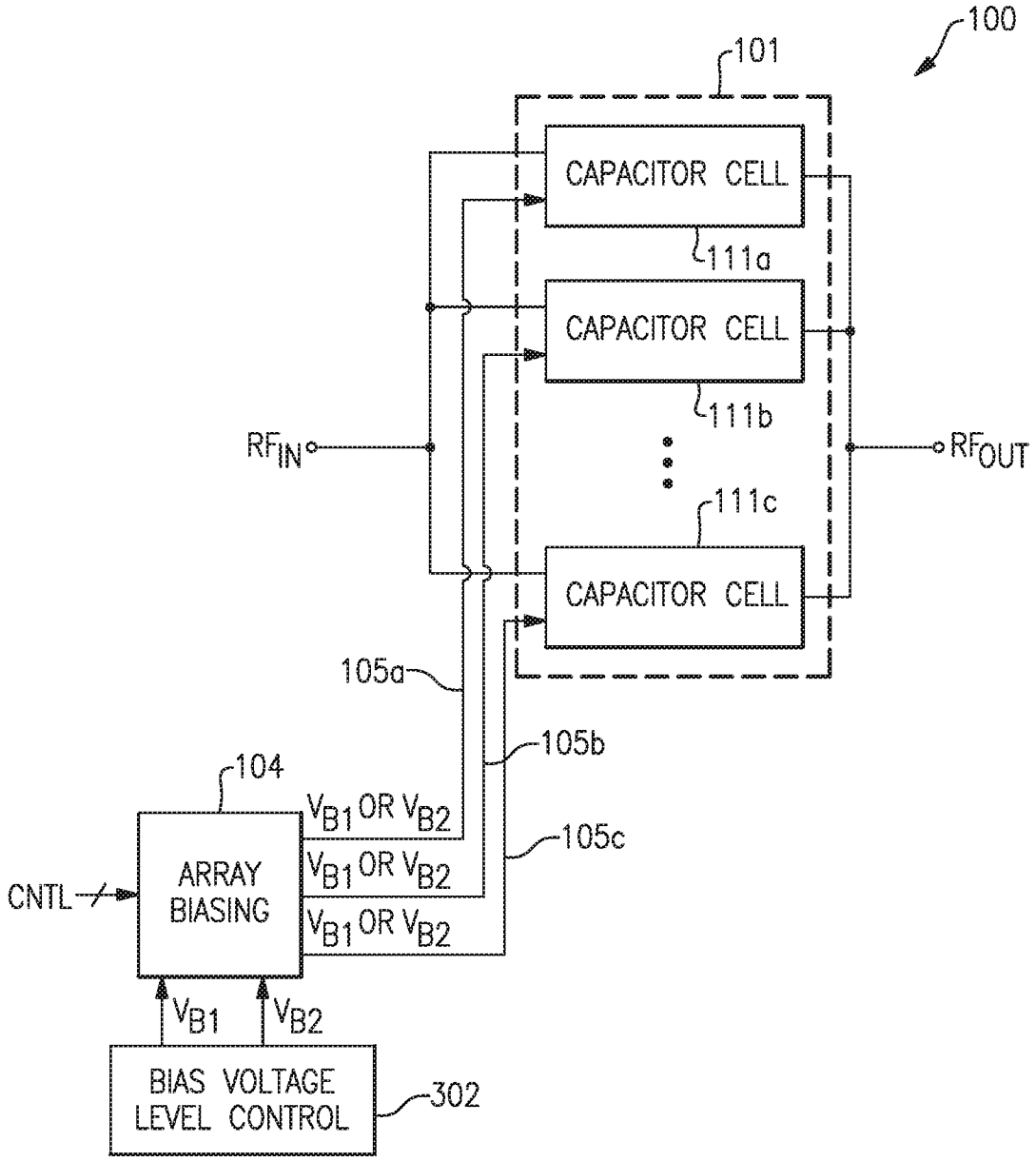
FIG. 3 is a schematic diagram of an IC according to one embodiment.

FIG. 3 is a schematic diagram of an IC 100 according to another embodiment. The IC 100 includes a variable capacitor array 101, an array biasing circuit 104, and a bias voltage level control circuit 302. Although FIG. 3 illustrates a configuration in which the IC 100 includes one variable capacitor array, the IC 100 can be adapted to include additional variable capacitor arrays and/or other circuitry.

The variable capacitor array 101 includes a first variable capacitor cell 111*a*, a second variable capacitor cell 111*b*, and a third variable capacitor cell 111*c*, which have been electrically connected in parallel between an RF input $RF_{IN}$ and an RF output $RF_{OUT}$. Although the illustrated variable capacitor array 101 includes three variable capacitor cells, the variable capacitor array 101 can be adapted to include more or fewer variable capacitor cells.

The array biasing circuit 104 receives the control signal CNTL, and generates a first cell bias voltage 105*a* for the first variable capacitor cell 111*a*, a second cell bias voltage 105*b* for the second variable capacitor cell 111*b*, and a third cell bias voltage 105*c* for the third variable capacitor cell 111*c*.

The bias voltage level control circuit 302 provides a first bias voltage level $V_{B1}$ and a second bias voltage level $V_{B2}$ to be used by the array biasing circuit 104 for biasing the variable capacitor array 101. The bias voltage level control circuit 302 can adjust $V_{B1}$ and $V_{B2}$ to compensate for temperature-induced variations in capacitance of the variable capacitor cells 111*a*-111*c*.

In the illustrated configuration, the control signal CNTL can be used to set the voltage level of the first cell bias voltage 105*a* to a first bias voltage level $V_{B1}$ or to a second bias voltage level $V_{B2}$. Similarly, the control signal CNTL can be used to set the voltage level of the second cell bias voltage 105*b* to the first bias voltage level $V_{B1}$ or to the second bias voltage level $V_{B2}$, and to set the voltage level of the third cell bias voltage 105*c* to the first bias voltage level $V_{B1}$ or to the second bias voltage level $V_{B2}$.

By controlling the voltage levels of the cell bias voltages to the first or second bias voltage levels $V_{B1}$, $V_{B2}$, the variable capacitor array 101 can exhibit a small variation in capacitance in the presence of an RF signal at the RF input $RF_{IN}$. Accordingly, the variable capacitor array 101 can exhibit high linearity in the presence of RF signals.

The control signal CNTL can control an overall capacitance of the variable capacitor array 101. For example, the size of the first, second, and third MOS capacitors cells 111*a*-111*c* can be weighted relative to one another, and an overall capacitance of the variable capacitor array 101 can be based on a sum of the capacitances of the array's variable capacitor cells.

Configuring the array biasing circuit 104 to control a cell bias voltage to one of two voltage levels can simplify a coding scheme associated with the control signal CNTL. For example, in such a configuration, the control signal CNTL can comprise a digital control signal, and individual bits of the digital control signal can be used to control the cell bias voltages to a particular bias voltage level. In one embodiment, the array biasing circuit 104 comprises a decoder, such as a binary decoder or a thermometer decoder that sets the voltage levels of the cells bias voltages based on a state of the digital control signal.

The illustrated bias voltage level control circuit 302 controls the voltage levels of the first and second bias voltage levels $V_{B1}$, $V_{B2}$ to change with temperature to compensate the variable capacitor array 101 for changes to capacitance arising from temperature variation. Thus, the first and second bias voltage levels $V_{B1}$, $V_{B2}$ serve as temperature dependent bias voltages that have a temperature versus voltage characteristic that compensates the variable capacitor cells 111*a*-111*c* for changes in capacitance with respect to temperature. Thus, at a given capacitance setting, the variable capacitor array 101 exhibits a substantially constant capacitance even when in the presence of temperature variation.

Configuring the bias voltage level control circuit 302 to adjust the first and second bias voltage levels $V_{B1}$, $V_{B2}$ to compensate for temperature variations in capacitance of the variable capacitor cells 111*a*-*c* can reduce variations in the overall capacitance as a function of temperature.

Figure 4A:
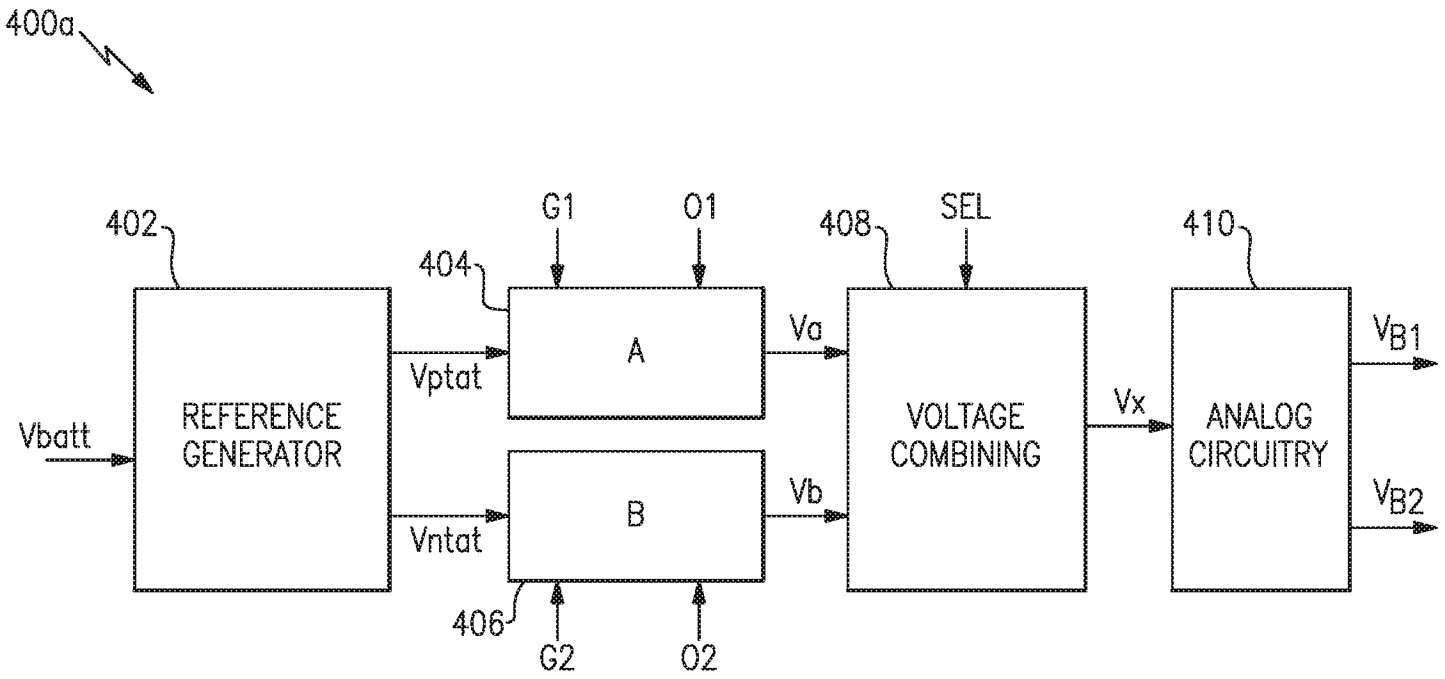
FIG. 4A is a schematic diagram of a temperature dependent bias voltage circuit according to one embodiment.

FIG. 4A is a schematic diagram of a temperature dependent bias voltage circuit 400*a* according to one embodiment. The temperature dependent bias voltage circuit 400*a* can also be referred to herein as a bias voltage level control circuit. The temperature dependent bias voltage circuit 400*a* includes a reference generator 402, a first voltage regulator 404 (labeled "A" in FIG. 4A), a second voltage regulator 406 (labeled "B" in FIG. 4A), a voltage combining circuit 408, and analog circuitry 410.

Although FIG. 4A illustrates one embodiment of a temperature dependent bias voltage circuit in accordance with the teachings herein, other configurations are possible. For example, in another embodiment, the voltage combining circuit 408 and the first and second voltage regulators 404, 406 are omitted in favor of using a single regulator. In such a configuration, the regulator can receive a temperature dependent reference signal (such as a PTAT or NTAT reference signal) and generate a regulated temperature dependent voltage for analog circuitry.

In the illustrated embodiment, the reference generator 402 receives power from a voltage supply, such as a battery voltage Vbatt, and generates a proportional to absolute temperature (PTAT) reference voltage Vptat and a negative to absolute temperature (NTAT) reference voltage Vntat. The PTAT reference voltage Vptat increases with temperature. In one example, the PTAT reference voltage Vptat is monotonically increasing with temperature and has a positive first derivative. The NTAT reference voltage Vntat can vary complementary with temperature so as to decrease with temperature. In one example, the NTAT reference voltage Vntat is monotonically decreasing with temperature and has a negative first derivative. In certain configurations, the PTAT reference voltage Vptat and the NTAT reference voltage Vntat change substantially linearly with temperature.

In one embodiment, the reference generator 402 is implemented using a bandgap reference generator. As persons of ordinary skill in the art will appreciate, a bandgap reference generator can be used to generate a temperature independent reference voltage by combing a PTAT reference signal and an NTAT reference signal in proper proportion. However, rather than using the temperature independent reference voltage, portions of the bandgap reference generator used to generate the PTAT reference signal and the NTAT reference signal can be advantageously used to generate the PTAT reference voltage Vptat and the NTAT reference voltage Vntat, respectively.

In certain implementations, the PTAT reference voltage Vptat and the NTAT reference voltage Vntat change with temperature, but are substantially independent of a voltage level of the battery voltage Vbatt when the battery voltage Vbatt is greater than or equal to a minimum operating voltage of the system. Thus, the temperature dependent bias voltage circuit can operate to provide temperature dependent bias voltages across a wide range of battery charge levels.

As shown in FIG. 4A, the first voltage regulator 404 receives the PTAT reference voltage Vptat, a gain control signal G1, and an offset control signal O1, and generates a PTAT regulated voltage Va. The first voltage regulator 404 can provide the PTAT regulated voltage Va to be proportional to the PTAT reference voltage Vptat such that the PTAT regulated voltage Va is equal to Vptat times a value of the gain control signal G1 plus a value of the offset control signal O1. Accordingly, the first voltage regulator 404 can be used to generate the PTAT regulated voltage Va to be proportional to absolute temperature and to have a controlled slope and/or offset relative to the PTAT reference voltage Vptat.

The second voltage regulator 406 receives the NTAT reference voltage Vntat, a gain control signal G2, and an offset control signal O2, and generates an NTAT regulated voltage Vb. The second voltage regulator 406 can provide the NTAT regulated voltage Vb to be proportional to the NTAT reference voltage Vntat such that the NTAT regulated voltage Vb is equal to Vntat times a value of the gain control signal G2 plus a value of the offset control signal O2. Accordingly, the second voltage regulator 406 can be used to generate the NTAT regulated voltage Vb to be complementary to absolute temperature and to have a controlled slope and/or offset relative to the NTAT reference voltage Vntat.

The voltage combining circuit 408 receives the PTAT and NTAT regulated voltages Va, Vb and a select signal SEL and provides a combined voltage Vx to the analog circuity 410. The select signal SEL is used to control generation of the combined voltage Vx based on the PTAT and NTAT regulated voltages Va, Vb. In one embodiment, the select signal SEL is used to generate the combined voltage Vx to be equal to Va or to be equal to Vb. In another embodiment, the select signal SEL is used to control factors or weights of the PTAT regulated voltage Va and the NTAT regulated voltage Vb in generating the combined voltage Vx. For example, the combined voltage Vx can be generated by a weighted sum of the PTAT regulated voltage Va and the NTAT regulated voltage Vb. For instance, the combined voltage Vx can be selected to be equal to k1*Va+k2*Vb, and the select signal SEL can control the values of k1 and k2.

The analog circuitry 410 generates the first and second bias voltage levels $V_{B1}$, $V_{B2}$. In certain configurations, the bias voltage levels $V_{B1}$, $V_{B2}$ are used to bias MOS variable capacitor cells of a variable capacitor array, as was described earlier with reference to FIG. 3. The first and second bias voltage levels $V_{B1}$, $V_{B2}$ have a temperature dependence that compensates for variations in capacitance as a function of temperature. Although an example in which the analog circuity generates two bias voltage levels is shown, the analog circuitry can be adapted to generate more or fewer bias voltage levels.

In certain configurations, the first bias voltage level $V_{B1}$ is less than a ground voltage and the second bias voltage level $V_{B2}$ is greater than the ground voltage. In one embodiment, the analog circuity 410 includes a negative charge pump that receives the combined voltage Vx and that generates the first bias voltage level $V_{B1}$. In one embodiment, the analog circuitry 410 includes a voltage buffer that generates the second bias voltage level $V_{B2}$ to be about equal to the combined voltage Vx. However, other configurations of the analog circuitry 410 are possible.

Thus, the temperature dependent bias voltage circuit 400*a* can change the temperature dependence or voltage versus temperature characteristics of the first and second bias voltage levels $V_{B1}$, $V_{B2}$ via the gain control signals G1,G2, the offset control signals O1, O2, and the select signal SEL.

In certain configurations, the gain control signals G1, G2, the offset control signals O1, O2, and/or the select signal SEL can be programmed (for example, during manufacturing or after IC power-up), and the temperature dependent bias voltage circuit can operate to compensate for a change in the overall capacitance of a variable capacitor array as temperature varies. In other configurations, the temperature dependent bias voltage circuit receives one or more inputs during operation to further enhance temperature compensation and/or to dynamically change the values of the gain control signals G1, G2, the offset control signals O1, O2, and/or the select signal SEL over time. For example, in some embodiments a feedback system can be used to monitor the overall capacitance of a variable capacitor array based on a parameter or an effect, such as temperature and/or frequency (for instance, carrier frequency). Additionally, the feedback system can adjust values of the gain control signals G1, G2, the offset control signals O1, O2, and/or the select signal SEL based on the observations.

The temperature dependent bias voltage circuit 400*a* can operate as the bias voltage level control circuit 302 of the IC 100 of FIG. 3 to control the first and second bias voltage levels $V_{B1}$, $V_{B2}$ to correct for a capacitance variation of the variable capacitor array 101 with temperature. However, the temperature dependent bias voltage circuit 400*a* can be used to provide temperature compensation in other configurations of ICs.

Figure 4B:
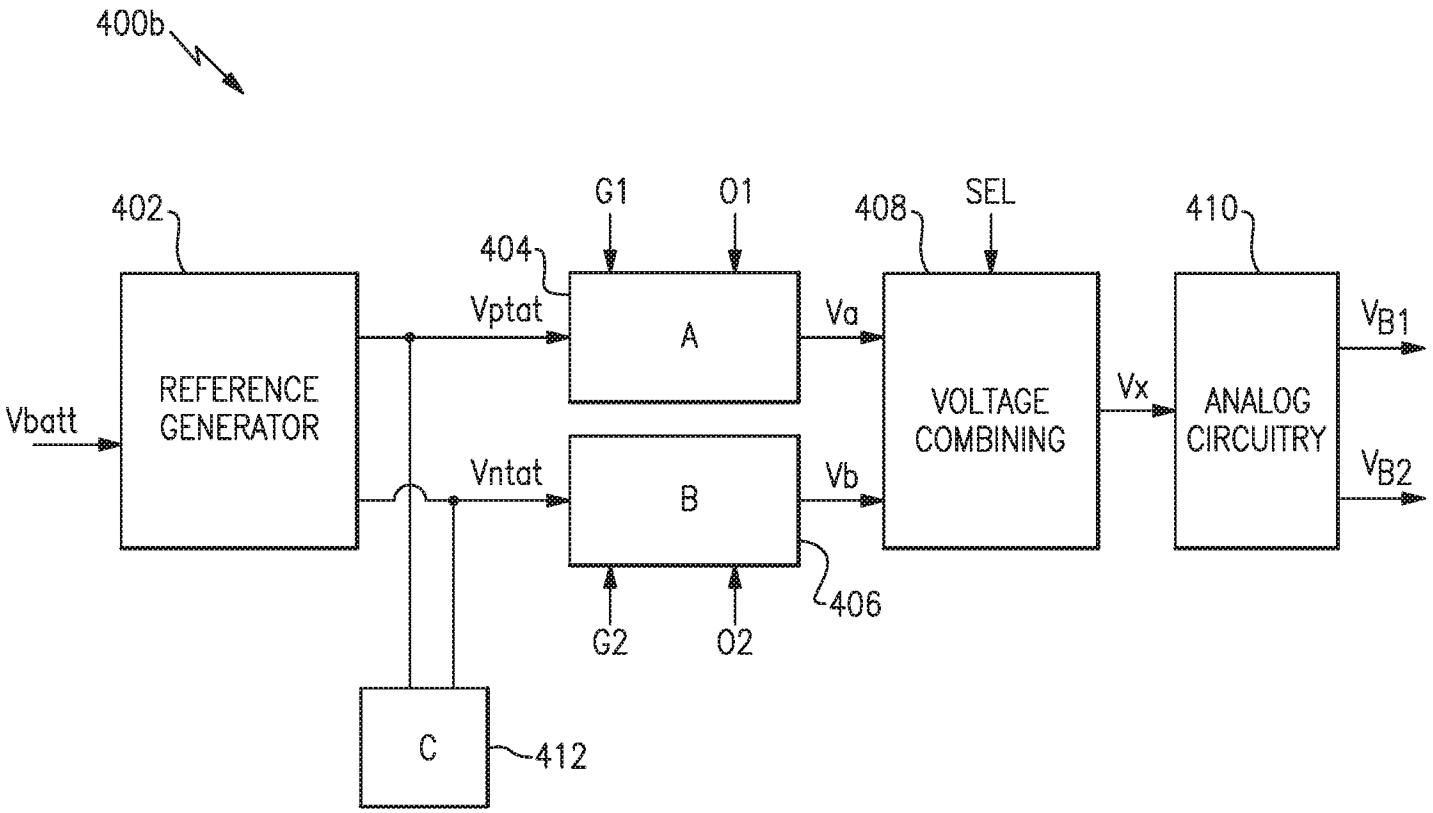
FIG. 4B is a schematic diagram of a temperature dependent bias voltage circuit according to another embodiment.

FIG. 4B is a schematic diagram of a temperature dependent bias voltage circuit 400*b* according to another embodiment. The temperature dependent bias voltage circuit 400*b* is similar to the temperature dependent bias voltage circuit 400*a* of FIG. 4A, except that the temperature dependent bias voltage circuit 400*b* further includes a monitor circuit 412 (labeled as "C" in FIG. 4B).

In certain implementations, the monitor circuit 412 can monitor the PTAT reference voltage Vptat and/or the NTAT reference voltage Vntat for data collection purposes. For instance, the monitor circuit 412 can store data related to observations of the reference voltages, such as slope and/or offset measurements, for use with an MCU or other circuitry. For example, the monitor circuit 412 can store observation data in a programmable memory, such as the programmable memory 440 discussed below with reference to FIG. 4C.

In one embodiment, the monitor circuit 412 generates one or more correction signals for regulator(s) and/or reference generator based on the observations, thereby further enhancing accuracy of the temperature dependent bias voltage circuit 400*b*. For example, the monitor circuit 412 can be used to observe and correct for non-idealities, such as temperature dependent effects, associated with the first and second regulators 404, 406.

Figure 4C:
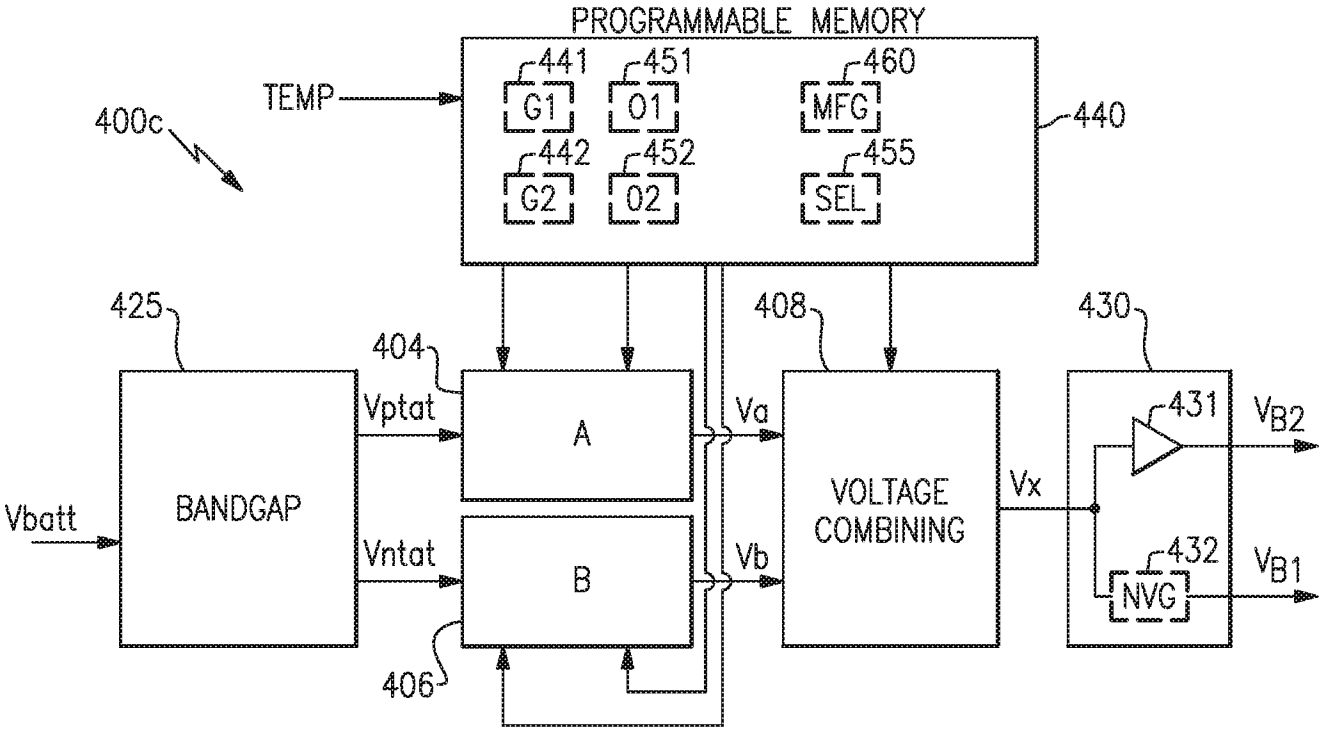
FIG. 4C is a schematic diagram of a temperature dependent bias voltage circuit according to another embodiment.

FIG. 4C is a schematic diagram of a temperature dependent bias voltage circuit 400*c* according to another embodiment. The temperature dependent bias voltage circuit 400*c* includes the first voltage regulator 404, the second voltage regulator 406, and the voltage combining circuit 408, which can be as described earlier. The temperature dependent bias voltage circuit 400*c* further includes a bandgap circuit 425 and analog circuitry 430, which illustrated one embodiment of the reference generator 402 and analog circuitry 410 of FIG. 4A, respectively. The temperature dependent bias circuit 400*c* further includes a programmable memory 440.

As shown in FIG. 4C, the bandgap circuit 425 can generate the PTAT reference voltage Vptat and the NTAT reference voltage Vntat. As persons of ordinary skill in the art will appreciate, a bandgap circuit can be used to generate a temperature independent reference voltage by combing a PTAT reference signal and an NTAT reference signal in proper proportion to generate a bandgap reference signal that is substantially independent of temperature. However, rather than generating a temperature independent reference voltage, the illustrated bandgap circuit 425 outputs a PTAT reference voltage Vptat and an NTAT reference voltage Vntat, which are typically internal to a bandgap circuit and not provided as outputs.

As shown in FIG. 4C, the analog circuitry 430 includes a buffer 431 and a negative voltage generator (NVG) 432. The buffer 431 has an input configured to receive the voltage Vx and an output configured to control the second bias voltage level $V_{B2}$. The buffer 431 can be a unity gain buffer, or it can provide additional gain or attenuation in controlling the second bias voltage level $V_{B2}$. The NVG 432 has an input configured to receive the voltage Vx and an output configured to control the first bias voltage $V_{B1}$. In one embodiment, the NVG 432 includes a negative charge pump configured to provide a negative voltage relative to ground using switched capacitors.

The temperature dependent bias circuit 400*c* also includes the programmable memory 440. As shown in FIG. 4C, the programmable memory 440 receives a temperature signal (TEMP) as an input. In certain implementations, the temperature signal is a system-level temperature signal, such as a temperature signal from a transceiver of a mobile device.

The illustrated programmable memory 440 provides a first gain and first offset control signal to the first voltage regulator 404, a second gain and second offset control signal to the second voltage regulator 406, and a select control signal to the voltage combining circuit 408. The programmable memory circuit 440 includes first gain data 441, second gain data 442, first offset data 451, second offset data 452, select data 455, and manufacturer data 460. The first gain data 441 and the first offset data 451 can be used to control the values of the first gain control signal G1 and the first offset control signal O1 as a function of the temperature signal. Similarly, the second gain data 442 and the second offset data 452 can be used to control the values of the second gain control signal G2 and the second offset control signal O2 as a function of the temperature signal. Furthermore, the select data 455 can be used to control the value of the select signal SEL as a function of the temperature signal. Implementing the temperature dependent bias circuit 400*c* in this manner can further enhance the accuracy of temperature compensation.

Thus, data stored in the programmable memory 440 can be used to generate control signals based on a value of a temperature signal (TEMP) received at the input of the programmable memory 440. In one embodiment, the control signals can be provided based upon a lookup table.

The programmable memory circuit 440 also includes manufacturer data 460, which can be used to provide correction to values of the gain control signals, offset control signals, and/or selection signal to compensate for process variation. In certain implementations, the manufacturer data 460 is programmed based on observations during factory test. Thus, the manufacturer data 460 can compensate for manufacturing variation by adjusting values of the gain control signals, offset control signals, and/or selection signal.

Figure 4D:
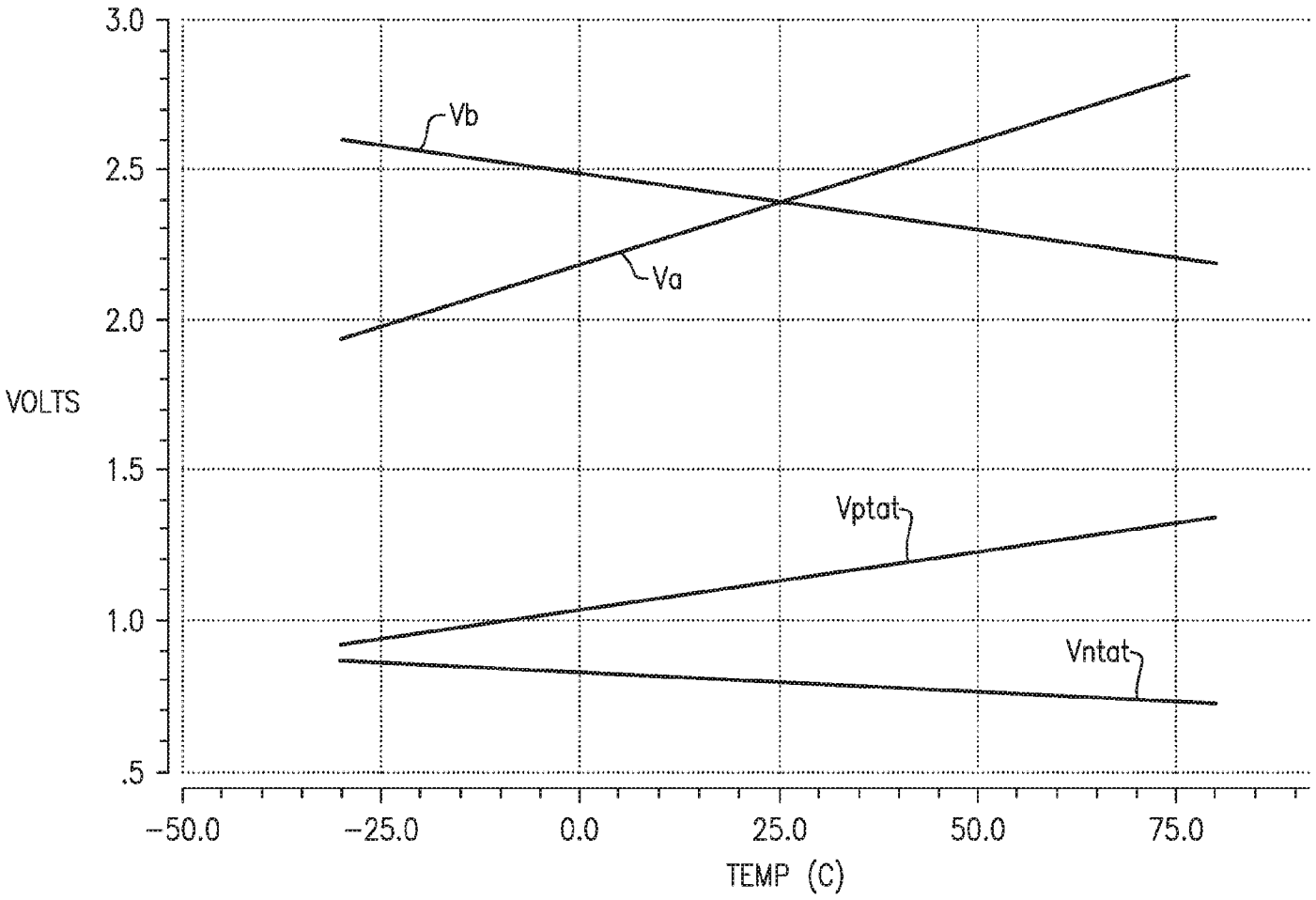
FIG. 4D is one example of a graph of voltage versus temperature for one embodiment of a temperature dependent bias voltage circuit.

FIG. 4D is one example of a graph of voltage versus temperature for a temperature dependent bias voltage circuit, such as the temperature dependent bias voltage circuit 400*a* of FIG. 4A. Although FIG. 4D illustrates one example graph for a temperature dependent bias voltage circuit, other results are possible, such as graphs that dependent on implementation and/or application.

The graph of FIG. 4D includes one example of voltage versus temperature plots for the PTAT reference voltage Vptat, the NTAT reference voltage Vntat, the PTAT regulated voltage Va, and the NTAT regulated voltage Vb. As shown in FIG. 4D, the PTAT regulated voltage Va is linearly related to the PTAT reference voltage Vptat. The relationship between the PTAT regulated voltage Va and the PTAT reference voltage Vptat can be controlled by the gain control signal G1 and the offset control signal O1. Similarly, the NTAT regulated voltage Vb is linearly related to the NTAT reference voltage Vntat, and the relationship can be control by the gain control signal G2 and the offset control signal O2.

As shown in FIG. 4D, the first and second voltage regulators 404, 406 advantageously allow the slope and/or offsets of the PTAT and NTAT regulated voltages Va, Vb to be tailored relatively to the PTAT reference voltage Vptat and the NTAT reference voltage Vntat. Thus, a suitable slope and/or offset for temperature compensation of a variable capacitor array can be obtained.

Figure 5A:
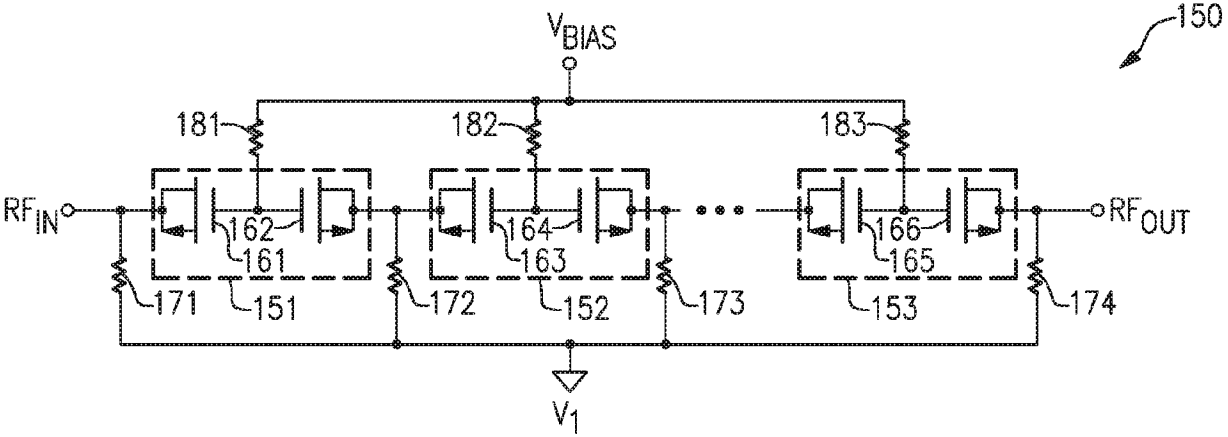
FIG. 5A is a circuit diagram of a variable capacitor cell according to one embodiment.

FIG. 5A is a circuit diagram of a variable capacitor cell 150 according to one embodiment. The variable capacitor cell 150 includes a first pair of anti-series MOS capacitors 151, a second pair of anti-series MOS capacitors 152, a third pair of anti-series MOS capacitors 153, a first DC biasing resistor 171, a second DC biasing resistor 172, a third DC biasing resistor 173, a fourth DC biasing resistor 174, a first control biasing resistor 181, a second control biasing resistor 182, and a third control biasing resistor 183.

Although the variable capacitor cell 150 is illustrated as including three pairs of anti-series MOS capacitors, the teachings herein are applicable to configurations including more or fewer pairs of anti-series MOS capacitors. For example, in one embodiment, a variable capacitor cell includes a cascade of between 2 and 18 pairs of anti-series MOS capacitors. Moreover, although illustrated in the context of cascading MOS capacitors to increase signal handling, the teachings herein are also applicable to non-cascaded configurations.

In the illustrated configuration, each of the pairs of anti-series MOS capacitors 151-153 includes two MOS capacitors electrically connected in anti-series or inverse series. For example, the first pair of anti-series MOS capacitors 151 includes a first MOS capacitor 161 and a second MOS capacitor 162. The first and second MOS capacitors 161, 162 have anodes associated with transistor gates and cathodes associated with transistor source and drain regions. As shown in FIG. 5A, the anode of the first MOS capacitor 161 is electrically connected to the anode of the second MOS capacitor 162. Additionally, the second pair of anti-series MOS capacitors 152 includes a third MOS capacitor 163 and a fourth MOS capacitor 164, and the anode of the third MOS capacitor 163 is electrically connected to the anode of the fourth MOS capacitor 164. Furthermore, the third pair of anti-series MOS capacitors 153 includes fifth MOS capacitor 165 and a sixth MOS capacitor 166, and the anode of the fifth MOS capacitor 165 is electrically connected to the anode of the sixth MOS capacitor 166.

As shown in FIG. 5A, the first to third pairs of anti-series MOS capacitors 151-153 are arranged in a cascade between the RF input $RF_{IN}$ and the RF output $RF_{OUT}$. For example, the cathode of the first MOS capacitor 161 is electrically connected to the RF input $RF_{IN}$, and the cathode of the second MOS capacitor 162 is electrically connected to the cathode of the third MOS capacitor 163. Additionally, the cathode of the fourth MOS capacitor 164 is electrically connected to the cathode of the fifth MOS capacitor 165, and a cathode of the sixth MOS capacitor 166 is electrically connected to the RF output $RF_{OUT}$.

Arranging two or more pairs of anti-series MOS capacitors in a cascade can increase a voltage handling capability of a variable capacitor cell relative to a configuration including a single pair of anti-series MOS capacitors. For example, arranging two or more pairs of anti-series MOS capacitors in a cascade can increase a voltage handling and/or power handling capability of the variable capacitor cell by distributing RF signal voltage across multiple MOS capacitors.

Accordingly, cascading several pairs of anti-series MOS capacitors can achieve high voltage operation of a variable capacitor cell.

Additionally, the illustrated variable capacitor cell 150 includes pairs of MOS capacitors that are electrically connected in anti-series, which can decrease capacitance variation in the presence of RF signals. For example, when the first and second variable capacitors are each biased with a particular cell bias voltage, the variable capacitors' capacitance may change when an RF input signal is received on the RF input $RF_{IN}$. However, a capacitance variation $\Delta C$ between MOS capacitors in a given pair can have about equal magnitude, but opposite polarity.

For instance, in the presence of an RF input signal that generates a capacitance variation having a magnitude $\Delta C$, a first MOS capacitor of a pair of anti-series MOS capacitors may have a capacitance $C_V+\Delta C$, while the second MOS capacitor may have a capacitance $C_V-\Delta C$. Thus, the total capacitance of the anti-series combination of the first and second MOS capacitors 121, 122 can be about equal to $\frac{1}{2}C_V-\frac{1}{2}\Delta C^2/C_V$. Since $\frac{1}{2}\Delta C^2$ is typically much smaller than $\Delta C$, the anti-series MOS capacitors can exhibit small capacitance variation when RF signals propagate through the variable capacitor cell.

Accordingly, the illustrated variable capacitor cell 150 can provide reduced capacitance variation in the presence of RF signals.

In the illustrated configuration, the first to fourth DC biasing resistors 171-174 have been used to bias the cathodes of the MOS capacitors 161-166 with the first voltage $V_1$, which can be a ground, power low supply, or other reference voltage in certain implementations. Additionally, the first to third control biasing resistors 181-183 are used to bias the anodes of the MOS capacitors 161-166 with the cell bias voltage $V_{BIAS}$.

In one embodiment, the DC biasing resistors 171-174 have a resistance selected in the range of 10 kΩ to 10,000 kΩ, and the control biasing resistors 181-183 have a resistance selected in the range of 10 kΩ to 10,000 kΩ. Although one example of resistance values have been provided, other configurations are possible. For example, choosing relatively low resistance values for the biasing resistors can increase control over DC biasing conditions, but can also undesirably increase signal loss and/or degrade linearity since the resistors operate in shunt to an RF signal propagating through the variable capacitor cell. Accordingly, resistance values can vary depending on application, fabrication process, and/or desired performance specifications.

The bias voltages across the MOS capacitors 161-166 can be based on a voltage difference between the cell bias voltage $V_{BIAS}$ and the first voltage $V_1$. Additionally, an array biasing circuit, such as the array biasing circuit 104 of FIG. 3, can be used to control a voltage level of the cell bias voltage $V_{BIAS}$ to control the variable capacitor cell's capacitance between the RF input $RF_{IN}$ and the RF output $RF_{OUT}$.

In certain configurations, the array biasing circuit can control the cell bias voltage $V_{BIAS}$ to a voltage level selected from a discrete number of two or more bias voltage levels associated with high linearity. Thus, rather than biasing the MOS capacitors at a bias voltage level selected from a continuous tuning voltage range, the array biasing circuit biases cells using a discrete set of bias voltage levels associated with high linearity. In one embodiment, the array biasing circuit biases a particular MOS capacitor either at a first bias voltage level associated with an accumulation mode of the MOS capacitor or at a second bias voltage level associated an inversion mode of the MOS capacitor.

At a fixed temperature such as room temperature, biasing the MOS capacitors 161-166 in this manner can improve linearity relative to a configuration in which the MOS capacitors 161-166 are biased at a bias voltage level selected from a continuous tuning voltage range. For example, a MOS capacitor can exhibit a change in capacitance in response to changes in an applied RF signal, and a magnitude of the capacitance change can vary with the MOS capacitor's bias voltage level.

Accordingly, the illustrated variable capacitor cell 150 can provide high linearity between the RF input $RF_{IN}$ and the RF output $RF_{OUT}$ when temperature is constant.

The capacitance of the variable capacitor cell 150 can also change with temperature. By controlling the biasing levels as a function of temperature, a change of capacitance with temperature can be compensated for.

Figure 5B:
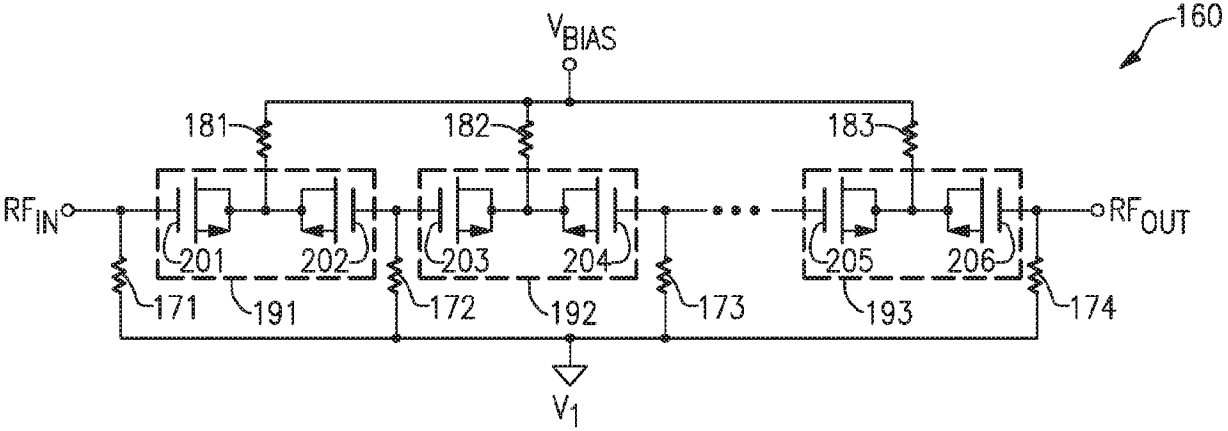
FIG. 5B is a circuit diagram of a variable capacitor cell according to another embodiment.

FIG. 5B is a circuit diagram of a variable capacitor cell 160 according to another embodiment. The variable capacitor cell 160 includes a first pair of anti-series MOS capacitors 191, a second pair of anti-series MOS capacitors 192, a third pair of anti-series MOS capacitors 193, a first DC biasing resistor 171, a second DC biasing resistor 172, a third DC biasing resistor 173, a fourth DC biasing resistor 174, a first control biasing resistor 181, a second control biasing resistor 182, and a third control biasing resistor 183. Although the variable capacitor cell 160 is illustrated as including three pairs of anti-series MOS capacitors, the teachings herein are applicable to configurations including more or fewer pairs of anti-series MOS capacitors.

The variable capacitor cell 160 of FIG. 5B is similar to the variable capacitor cell 150 of FIG. 5A, except that the variable capacitor cell 160 illustrates a different anti-series configuration of the pairs of anti-series MOS capacitors 191-193.

In particular, in contrast to the variable capacitor cell 150 of FIG. 5A in which the anodes of the MOS capacitors of a given pair are electrically connected to one another, the variable capacitor cell 160 of FIG. 5B illustrates a configuration in which the cathodes of a given pair of MOS capacitors are electrically connected to one another. For example, the first pair of MOS capacitors 191 includes a first MOS capacitor 201 and a second MOS capacitor 202, and the cathodes of the first and second MOS capacitors 201, 202 are electrically connected to one another. Similarly, the second pair of MOS capacitors 192 includes a third MOS capacitor 203 and a fourth MOS capacitor 204, and the cathodes of the third and fourth MOS capacitors 203, 204 are electrically connected to one another. Likewise, the third pair of MOS capacitors 193 includes a fifth MOS capacitor 205 and a sixth MOS capacitor 206, and the cathodes of the fifth and sixth MOS capacitors 205, 206 are electrically connected to one another.

As shown in FIG. 5B, the pairs of anti-series MOS capacitors 191-193 are electrically connected in a cascade between the RF input $RF_{IN}$ and the RF output $RF_{OUT}$. For example, the anode of the first MOS capacitor 201 is electrically connected to the RF input $RF_{IN}$, and the anode of the second MOS capacitor 202 is electrically connected to the anode of the third MOS capacitor 203. Additionally, the anode of the fourth MOS capacitor 204 is electrically connected to the anode of the fifth MOS capacitor 205, and an anode of the sixth MOS capacitor 206 is electrically connected to the RF output $RF_{OUT}$.

In the illustrated configuration, the first to fourth DC biasing resistors 171-174 are used to bias the anodes of the MOS capacitors 201-206 with the first voltage $V_1$, which can be a ground, power low supply, or other reference voltage in certain implementations. Additionally, the first to third control biasing resistors 181-183 are used to bias the cathodes of the MOS capacitors 201-206 with the cell bias voltage $V_{BIAS}$.

In certain configurations, the variable capacitor cell 150 of FIG. 5A can be more robust against damage from electrostatic discharge (ESD) events relative to the variable capacitor cell 160 of FIG. 5B.

For example, the RF input $RF_{IN}$ and RF output $RF_{OUT}$ of a variable capacitor cell may be electrically connected to input and output pins of an IC on which the variable capacitor cell is fabricated. Since a MOS capacitor's source and drain regions typically can withstand a greater voltage relative to the MOS capacitor's gate region when fabricated using certain manufacturing processes, the variable capacitor cell 150 of FIG. 5A may exhibit a greater robustness to ESD events or other overvoltage conditions relative to the variable capacitor cell 160 of FIG. 5B.

Additional details of the variable capacitor cell 160 can be similar to those described earlier.

Figure 6:
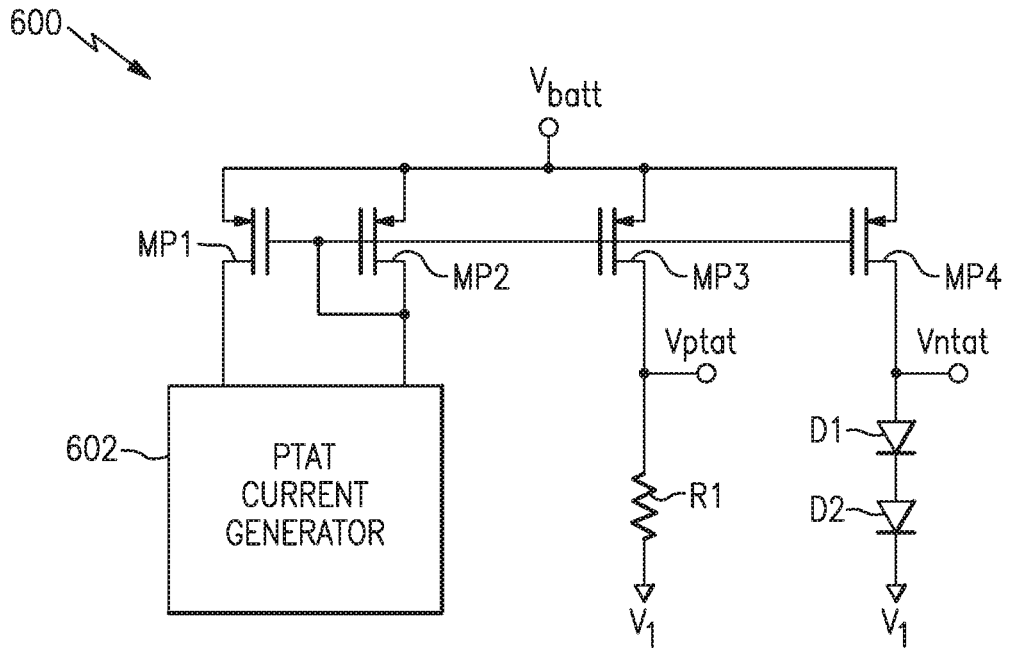
FIG. 6 is a circuit diagram of a reference generator according to one embodiment.

FIG. 6 is a circuit diagram of a reference generator 600 according to one embodiment. The reference generator 600 includes a proportional to absolute temperature (PTAT) current generator 602, a PMOS MP1, a PMOS MP2, a PMOS MP3, a PMOS MP4, a resistor R1, a diode D1, and a diode D2. As shown in FIG. 6, a source of each PMOS MP1-MP4 is electrically connected to the supply voltage Vbatt. A drain of the PMOS MP1 and a drain of the PMOS MP2 are electrically connected to the PTAT current generator 602, which generates a PTAT drain current in the PMOS MP2. A gate of each of the PMOS MP1-MP4 is electrically connected to the drain of the PMOS MP2 to provide a current mirror. Thus, a drain current of the PMOS MP1, a drain current of the PMOS MP3, and a drain current of the PMOS MP4 can also be PTAT drain currents.

The resistor R1 is electrically connected between ground and the drain of the PMOS MP3 such that the PTAT reference voltage Vptat can be provided at the drain of the PMOS MP3. The PTAT reference voltage Vptat is thus proportional to absolute temperature when temperature variations of the resistor R1 do not cancel the PTAT the drain current of the PMOS MP3. For instance if the resistance R1 is constant or also proportional to absolute temperature, then the PTAT reference voltage Vptat can be proportional to absolute temperature.

The diodes D1 and D2 are electrically connected in series between ground and the drain of the PMOS MP4 such that the NTAT reference voltage Vntat can be provided at the drain of the PMOS MP4. The NTAT reference voltage Vntat can have the desired property of being complementary to absolute temperature because the two diodes have a temperature dependence which is complementary to absolute temperature and which has a stronger dependence with temperature than the drain current of the PMOS MP4. In this case a complementary to absolute temperature (NTAT) property of both the diodes D1 and D2 dominates the voltage at the drain of the PMOS MP4 so that the NTAT reference voltage Vntat can exhibit complementary to absolute temperature behavior.

Although the reference generator 600 shows one embodiment of a circuit for generating the PTAT reference voltage Vptat and the NTAT reference voltage Vntat, other configurations are possible. Thus, other components and circuit configurations can provide proportional or complementary to absolute temperature reference signals, such as voltages or currents.

Figure 7A:
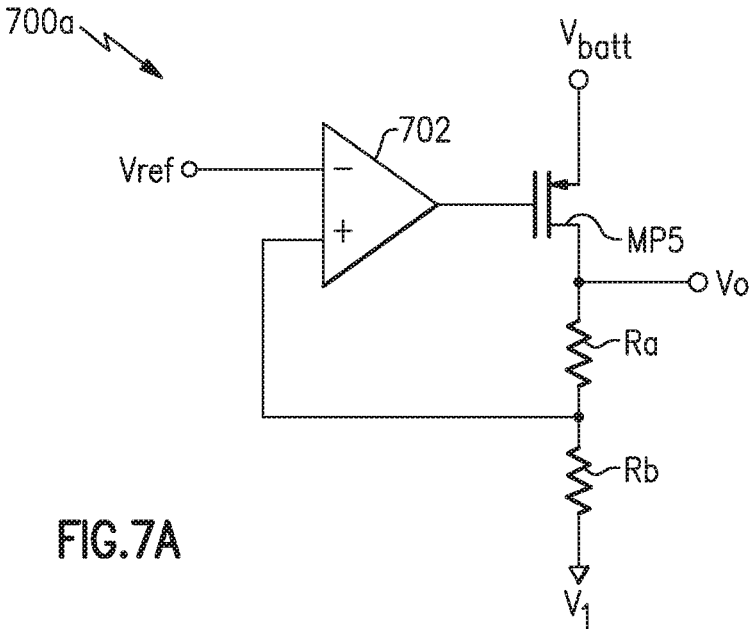
FIG. 7A is a circuit diagram of a linear regulator according to one embodiment.

FIG. 7A is a circuit diagram of a linear regulator 700*a* according to one embodiment. The linear regulator 700*a* includes an amplifier 702, a PMOS MP5, a resistor Ra, and a resistor Rb. An output of the amplifier 702 is electrically connected to a gate of the PMOS MP5. An inverting input of the amplifier 702 receives a reference voltage Vref while a noninverting input of the amplifier 702 is electrically connected to a first terminal of the resistor Ra and a first terminal of the resistor Rb. A second terminal of the resistor Rb is electrically connected to ground and a second terminal of the resistor Ra is electrically connected to a drain of the PMOS MP5. The source of the PMOS MP5 is electrically connected to the supply voltage Vbatt.

As one of ordinary skill in the art will appreciate, the linear regulator 700*a* is configured as a low dropout (LDO) regulator providing a voltage Vo that is based on the reference voltage Vref and the ratio of the resistance of the resistor Ra to the resistance of the resistor Rb. Additionally, the PMOS MP5 can operate as a pass device.

The linear regulator 700*a* can be used to realize the first voltage regulator 404 and/or the second voltage regulator 406 of FIGS. 4A-4C. For instance, when the voltage Vref of FIG. 7A is the PTAT reference voltage Vptat, then the output voltage Vo can correspond to the PTAT regulated voltage Va. The gain G1 and the offset O1 can be determined by the resistances of the resistors Ra and Rb. Similarly, when the voltage Vref is the NTAT reference voltage Vntat, then the voltage Vo can correspond to the regulator voltage Vb. The gain G2 and the offset O2 can also be determined by the resistances of the resistors Ra and Rb.

Although the reference generator 700*a* shows one embodiment of a regulator that can be used in a bias voltage level control circuit, the teachings herein are applicable to a wide range of regulators, including, but not limited to, linear regulators and/or switching regulators.

Figure 7B:
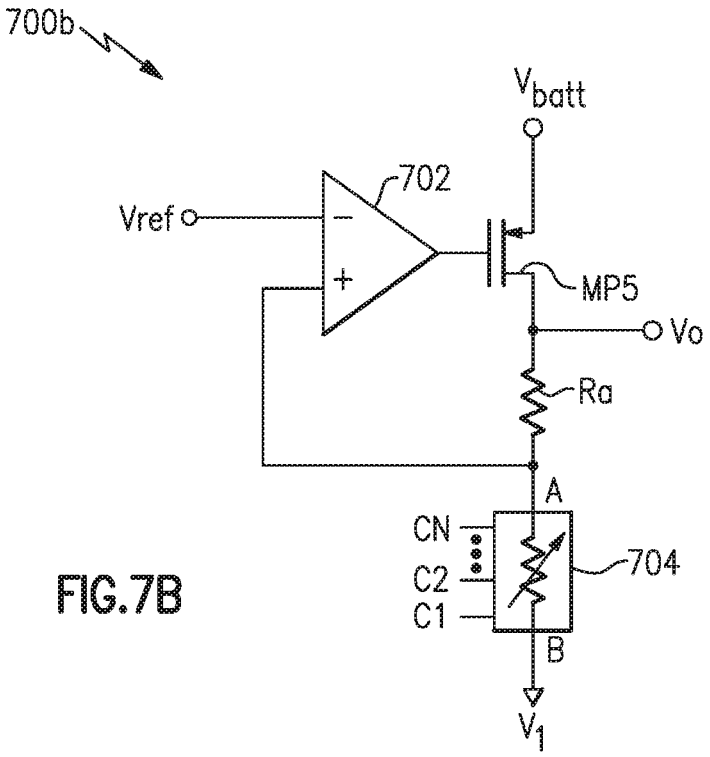
FIG. 7B is a circuit diagram of a linear regulator according to another embodiment.

FIG. 7B is a circuit diagram of a linear regulator 700*b* according to another embodiment. The linear regulator is similar to the linear regulator 700*a* of FIG. 7A, except the resistor Rb has been implemented using a digitally-controlled resistor 704. The digitally-controlled resistor 704 is configured to receive a digital code via control signals C1-CN. In some embodiments, the control signals can be generated by a decoder, such as a thermometer decoder, and the resistance of the digital resistor 704 can be controlled by, for instance, an MCU or a logic control unit. By controlling the resistance of the digital resistor 704, a gain and/or offset of the linear regulator 700*b* can be adjusted. With reference to FIGS. 4A-4C, the gain control signals G1, G2 and the offset control signals O1, O2 of FIGS. 4A-4C can be realized through the control of the digital resistor 704. However, other configurations are possible.

Figure 7C:
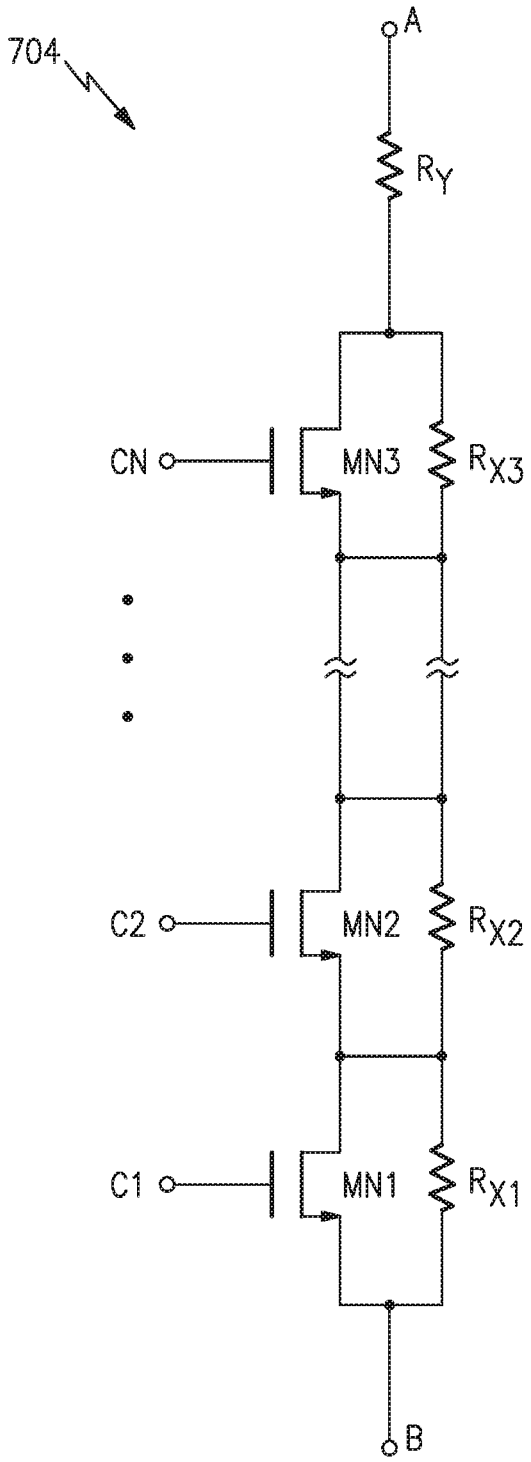
FIG. 7C is a circuit diagram of a digitally-programmable resistor for use in the linear regulator of FIG. 7B according to one embodiment.

FIG. 7C is a circuit diagram of the digitally-programmable resistor 704 for use in the linear regulator of FIG. 7B according to one embodiment. The digital resistor includes a resistor Ry, a resistor Rx1, a resistor Rx2, a resistor Rx3, an NMOS MN1, an NMOS MN2, and an NMOS MN3. The resistor Rx1 is connected in parallel across a drain and a source of the NMOS MN1. Similarly the resistor Rx2 is electrically connected in parallel across a drain and a source of the NMOS MN2, and the resistor Rx3 is electrically connected in parallel across a drain and a source of the NMOS MN3. The resistors Rx1, Rx2, and Rx3 are electrically connected in series between a terminal B of the digital resistor 704 and a first terminal of the resistor Ry. A second terminal of the resistor Ry is electrically connected to a terminal A of the digital resistor 704.

As shown in FIG. 7C a gate of NMOS MN1, MN2, and MN3 receives gate control signals C1, C2, and CN, respectively. A resistance of the digital resistor 704 can be controlled via the gate control signals C1, C2, and CN. When a gate control signal is a logic high, then the corresponding NMOS can operate as a short or low impedance. Additionally, when a gate control signal is a logic low, then the corresponding NMOS can operate as an open or high impedance. In this way, the resistances of the resistors R1-R3 can be selectively included or excluded to provide a variable resistance based upon the logic levels of the gate control signals C1, C2, and CN.

Although the digital resistor 704 shows an embodiment having three NMOS MN1-MN3 and three resistors R1-R3, other configurations including more or fewer or fewer resistors are possible. Moreover, other configurations of programmable resistors are possible.

CONCLUSION

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." The word "coupled", as generally used herein, refers to two or more elements that may be either directly connected, or connected by way of one or more intermediate elements. Likewise, the word "connected", as generally used herein, refers to two or more elements that may be either directly connected, or connected by way of one or more intermediate elements. Additionally, the words "herein," "above," "below," and words of similar import, when used in this application, shall refer to this application as a whole and not to any particular portions of this application. Where the context permits, words in the above Detailed Description using the singular or plural number may also include the plural or singular number respectively. The word "or" in reference to a list of two or more items, that word covers all of the following interpretations of the word: any of the items in the list, all of the items in the list, and any combination of the items in the list.

Moreover, conditional language used herein, such as, among others, "can," "could," "might," "can," "e.g.," "for example," "such as" and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while processes or blocks are presented in a given order, alternative embodiments may perform routines having steps, or employ systems having blocks, in a different order, and some processes or blocks may be deleted, moved, added, subdivided, combined, and/or modified. Each of these processes or blocks may be implemented in a variety of different ways. Also, while processes or blocks are at times shown as being performed in series, these processes or blocks may instead be performed in parallel, or may be performed at different times.

The teachings of the invention provided herein can be applied to other systems, not only the system described above. The elements and acts of the various embodiments described above can be combined to provide further embodiments.

While certain embodiments of the inventions have been described, these embodiments have been presented by way of example only, and are not intended to limit the scope of the disclosure. Indeed, the novel methods and systems described herein may be embodied in a variety of other forms; furthermore, various omissions, substitutions and changes in the form of the methods and systems described herein may be made without departing from the spirit of the disclosure. The accompanying claims and their equivalents are intended to cover such forms or modifications as would fall within the scope and spirit of the disclosure.

What is claimed is:

1. An integrated circuit comprising:

a variable capacitor array comprising a plurality of variable capacitor cells;

an array biasing circuit configured to bias the plurality of variable capacitor cells to control a capacitance of the variable capacitor array, wherein the array biasing circuit is configured to bias the plurality of variable capacitor cells based on one or more temperature dependent bias voltages; and a bias voltage level control circuit configured to generate the one or more temperature dependent bias voltages, wherein the bias voltage level control circuit comprises:

a reference generator configured to generate a first temperature dependent reference signal;

a first voltage regulator configured to generate a first regulated temperature dependent voltage based on the first temperature dependent reference signal; and analog circuitry configured to generate the one or more temperature dependent bias voltages based on the first regulated temperature dependent voltage, wherein the one or more temperature dependent bias voltages are operable to compensate for a change in the capacitance of the variable capacitor array with temperature.

2. The integrated circuit of claim 1, wherein the reference generator is further configured to generate a second temperature dependent reference signal, wherein the bias voltage level control circuit further comprises a second voltage regulator configured to generate a second regulated temperature dependent voltage based on the second temperature dependent reference signal.

3. The integrated circuit of claim 2, wherein the first regulated temperature dependent voltage comprises a proportional to absolute temperature (PTAT) voltage, and wherein the second regulated temperature dependent voltage comprises a negative to absolute temperature (NTAT) voltage.

4. The integrated circuit of claim 3, wherein the bias voltage level control circuit further comprises a voltage combining circuit configured to generate a combined voltage based on combining the PTAT voltage and the NTAT voltage, wherein the analog circuitry is further configured to generate the one or more temperature dependent bias voltages based on the combined voltage.

5. The integrated circuit of claim 4, wherein the analog circuitry comprises a negative voltage generator.

6. The integrated circuit of claim 1, wherein the first voltage regulator is programmable to control at least one of a slope or an offset of the first regulated temperature dependent voltage.

7. The integrated circuit of claim 6, further comprising a programmable memory including gain data and offset data, wherein the programmable memory is configured to control the slope of the first regulated temperature dependent voltage based on the gain data and a temperature signal, and wherein the programmable memory is further configured to control the offset of the first regulated temperature dependent voltage based on the offset data and the temperature signal.

8. The integrated circuit of claim 1, wherein the first voltage regulator comprises a low dropout (LDO) regulator.

9. The integrated circuit of claim 1, further comprising a monitor circuit configured to monitor at least one of a slope or an offset of the first temperature dependent reference signal.

10. The integrated circuit of claim 1, wherein the plurality of variable capacitor cells comprise a plurality of metal oxide semiconductor (MOS) capacitors, wherein the array biasing circuit is configured to bias each of the plurality of variable capacitor cells to either a first bias voltage level or to a second bias voltage level, wherein the first and second bias voltage levels are based on the one or more temperature dependent bias voltages.

11. A method of providing a variable capacitance in a radio frequency (RF) system, the method comprising:

generating a first temperature dependent reference signal using a reference generator;

generating a first regulated temperature dependent voltage based on the first temperature dependent reference signal using a first voltage regulator;

generating one or more temperature dependent bias voltages based on the first regulated temperature dependent voltage using analog circuitry; and controlling a capacitance of a variable capacitor array by biasing a plurality of variable capacitor cells of the variable capacitor array using an array biasing circuit, wherein controlling the capacitance of the variable capacitor array comprises biasing the plurality of variable capacitor cells based on the one or more temperature dependent bias voltages to compensate for a change in the capacitance of the variable capacitor array with temperature.

12. The method of claim 11, further comprising generating a second temperature dependent reference signal using the reference generator, and generating a second regulated temperature dependent voltage based on the second temperature dependent reference signal using a second voltage regulator, wherein the first regulated temperature dependent voltage comprises a PTAT voltage and the second regulated temperature dependent voltage comprises an NTAT voltage.

13. The method of claim 12, further comprising combining the PTAT voltage and the NTAT voltage to generate a combined voltage, and generating the one or more temperature dependent bias voltages based on the combined voltage using the analog circuitry.

14. The method of claim 11, further comprising programming the first voltage regulator to control at least one of a slope or an offset of the first regulated temperature dependent voltage.

15. The method of claim 11, further comprising monitoring at least one of a slope or an offset of the first temperature dependent reference signal using a monitor circuit.

16. The method of claim 11, wherein controlling the capacitance of the variable capacitor array comprises biasing a plurality of pairs of MOS capacitors.

17. A bias voltage level control circuit for a variable capacitor, the bias voltage level control circuit comprising:

a reference generator configured to generate a first temperature dependent reference signal;

a first voltage regulator configured to generate a first regulated temperature dependent voltage based on the first temperature dependent reference signal; and analog circuitry configured to generate one or more temperature dependent bias voltages based on the first regulated temperature dependent voltage, wherein one or more voltage levels of the one or more temperature dependent bias voltages change with temperature to compensate for a change in a capacitance of the variable capacitor with temperature.

18. The bias voltage level control circuit of claim 17, wherein the reference generator is further configured to generate a second temperature dependent reference signal, wherein the bias voltage level control circuit further comprises a second voltage regulator configured to generate a second regulated temperature dependent voltage based on the second temperature dependent reference signal, wherein the first regulated temperature dependent voltage comprises a PTAT voltage and the second regulated temperature dependent voltage comprises an NTAT voltage.

19. The bias voltage level control circuit of claim 18, wherein the bias voltage level control circuit further comprises a voltage combining circuit configured to generate a combined voltage based on combining the PTAT voltage and the NTAT voltage, wherein the analog circuitry is further configured to generate the one or more temperature dependent bias voltages based on the combined voltage.

20. The bias voltage level control circuit of claim 17, wherein the first voltage regulator is programmable to control at least one of a slope or an offset of the first regulated temperature dependent voltage.

* * * * *